US010473381B2

(12) United States Patent
Petrenko et al.

(10) Patent No.: US 10,473,381 B2
(45) Date of Patent: Nov. 12, 2019

(54) HIGH-FREQUENCY SELF-DEFROSTING EVAPORATOR COIL

(71) Applicant: Betterfrost Technologies Inc., Toronto (CA)

(72) Inventors: Victor F. Petrenko, Rochester, NY (US); Sameh M. I. Saad, Hamilton (CA); Kazi Kased L. Ahmed, Toronto (CA)

(73) Assignee: BETTERFROST TECHNOLOGIES INC., Toronto (CA)

( * ) Notice: Subject to any disclaimer, the term of this patent is extended or adjusted under 35 U.S.C. 154(b) by 220 days.

(21) Appl. No.: 15/722,375

(22) Filed: Oct. 2, 2017

(65) Prior Publication Data

US 2018/0094849 A1 Apr. 5, 2018

Related U.S. Application Data

(60) Provisional application No. 62/404,536, filed on Oct. 5, 2016.

(51) Int. Cl.
*F25D 21/08* (2006.01)
*F25D 21/00* (2006.01)
(Continued)

(52) U.S. Cl.
CPC ..... *F25D 21/08* (2013.01); *F25D 21/006* (2013.01)

(58) Field of Classification Search
CPC ..... F25D 21/08; F25D 21/006; F25B 39/02; H05B 6/108
See application file for complete search history.

(56) References Cited

U.S. PATENT DOCUMENTS 3,524,966 A 8/1970 Ando
3,575,581 A 4/1971 Ando
(Continued)

FOREIGN PATENT DOCUMENTS

CN 201155863 Y 11/2008
CN 202041034 U 11/2011
(Continued)

OTHER PUBLICATIONS

PCT/CA2017/051170, Written Opinion and International Search Report, dated Jan. 26, 2018.

*Primary Examiner* — Ljiljana V. Ciric
(74) *Attorney, Agent, or Firm* — Bereskin & Parr LLP/S.E.N.C.R.L., s.r.l.

(57) ABSTRACT

A method and system for defrosting a refrigerant coil using at least one of resistive and electromagnetic heating. The method and system involves providing a refrigerant tube formed from an electrically conductive material, an upstream refrigerant conduit for supplying a refrigerant to the refrigerant tube, and a downstream refrigerant conduit for receiving the refrigerant from the refrigerant tube; determining at least one of a desired resistive heating and electromagnetic heating for defrosting the refrigerant tube; providing an electrical coupler, connectable between a standard line voltage from an external power source, the standard line voltage having an externally determined voltage value and an externally determined standard line frequency and the refrigerant tube; determining at least one parameter of the refrigerant tube; based on the at least one parameter of the refrigerant tube, determining a target frequency of a high-frequency alternating current to apply to the refrigerant tube to provide the at least one of the desired resistive heating and electromagnetic heating when the high-frequency alternating current is applied to the refrigerant tube,
(Continued)

the target frequency being higher than the externally determined standard line frequency.

27 Claims, 26 Drawing Sheets

(51) Int. Cl.
*F25B 39/02* (2006.01)
*H05B 6/10* (2006.01)

(56) References Cited

U.S. PATENT DOCUMENTS 3,591,770 A 7/1971 Ando
3,617,699 A 11/1971 Othmer
3,619,537 A 11/1971 Nara
3,632,975 A 1/1972 Ando
3,718,804 A 2/1973 Ando
4,183,223 A 1/1980 Alsenz
4,280,045 A 7/1981 Blackmore
4,334,142 A 6/1982 Blackmore
4,645,906 A 2/1987 Yagnik et al.
4,701,587 A 10/1987 Carter et al.
4,820,902 A * 4/1989 Gillery ..... B32B 17/10036 219/203
4,875,644 A * 10/1989 Adams ..... B64D 15/163 244/134 R
4,897,597 A * 1/1990 Whitener ..... G01N 27/048 324/693
5,156,010 A * 10/1992 Inoue ..... F25B 47/025 62/81
5,344,696 A * 9/1994 Hastings ..... B32B 7/02 428/220
5,390,961 A 2/1995 Guthrie
5,398,547 A * 3/1995 Gerardi ..... B64D 15/20 244/134 F
5,408,844 A * 4/1995 Stokes ..... F25C 5/08 249/79
5,441,305 A * 8/1995 Tabar ..... A63C 1/00 219/211
5,496,989 A * 3/1996 Bradford ..... B60S 1/026 219/482
5,571,437 A 11/1996 Rudd
5,605,418 A * 2/1997 Watanabe ..... E01C 11/265 219/528
5,886,321 A * 3/1999 Pinchok, Jr. ..... B32B 17/10036 219/203
5,902,962 A * 5/1999 Gazdzinski ..... G02B 6/4416 174/113 R
5,934,617 A * 8/1999 Rutherford ..... B64D 15/14 244/134 D
6,002,118 A 12/1999 Kawano et al.
6,018,152 A * 1/2000 Allaire ..... H02G 7/16 219/485
6,023,054 A 2/2000 Johnson, Jr.
6,031,214 A * 2/2000 Bost ..... B64D 15/12 219/202
6,129,314 A * 10/2000 Giamati ..... B64D 15/00 244/134 A
6,145,787 A * 11/2000 Rolls ..... B64D 15/12 219/545
6,227,492 B1 * 5/2001 Schellhase ..... B64D 15/12 244/134 D
6,239,601 B1 * 5/2001 Weinstein ..... B64D 15/20 324/649
6,246,831 B1 * 6/2001 Seitz ..... F24H 9/2021 219/483
6,266,969 B1 * 7/2001 Malnati ..... F25D 21/08 62/272
6,558,947 B1 * 5/2003 Lund ..... B01L 3/50851 219/428
6,563,053 B2 5/2003 Petrenko
6,684,647 B2 2/2004 Petrenko
6,723,971 B1 4/2004 Petrenko et al.
7,087,876 B2 8/2006 Petrenko
7,164,100 B2 1/2007 Petrenko et al.
8,424,324 B2 4/2013 Petrenko et al.
8,621,880 B2 1/2014 Kim et al.
8,931,296 B2 * 1/2015 Petrenko ..... F24D 19/0095 62/276
9,137,933 B2 9/2015 Koyama
2001/0052731 A1 * 12/2001 Petrenko ..... B60S 1/026 307/10.1
2002/0017466 A1 * 2/2002 Petrenko ..... B82Y 30/00 205/742
2002/0092849 A1 * 7/2002 Petrenko ..... B60S 1/026 219/772
2002/0096515 A1 * 7/2002 Petrenko ..... B60S 1/026 219/770
2002/0118550 A1 * 8/2002 Petrenko ..... B60S 1/026 363/1
2002/0170909 A1 * 11/2002 Petrenko ..... B60S 1/026 219/636
2002/0175152 A1 * 11/2002 Petrenko ..... B82Y 30/00 219/201
2003/0155467 A1 * 8/2003 Petrenko ..... A63C 1/30 244/134 R
2006/0272340 A1 * 12/2006 Petrenko ..... F25C 1/12 62/73
2007/0101753 A1 * 5/2007 Broadbent ..... F25B 39/02 62/349
2008/0196429 A1 * 8/2008 Petrenko ..... F25C 1/12 62/207
2011/0016903 A1 1/2011 Ballet et al.
2011/0132588 A1 * 6/2011 Petrenko ..... F24D 19/0095 165/181
2011/0233192 A1 9/2011 Parman
2013/0092678 A1 4/2013 Petrenko et al.
2015/0308731 A1 * 10/2015 Viklund ..... F28F 9/264 165/61
2018/0172333 A1 * 6/2018 Petrenko ..... F25B 39/02

FOREIGN PATENT DOCUMENTS

CN 206808598 U 12/2017
DE 202013006214 U1 3/2014
JP 2001091065 A 4/2001
JP 2006052875 A 2/2006
JP 2010121847 A 6/2010
WO 20070663916 A1 6/2007

* cited by examiner

Cross-sectional view

Cross-sectional view

Cross-sectional view

Cross-sectional view

HIGH-FREQUENCY SELF-DEFROSTING EVAPORATOR COIL

RELATED APPLICATIONS

This application claims priority from U.S. patent application No. 62/404,536, filed Oct. 5, 2016 entitled "HIGH-FREQUENCY SELF-DEFROSTING EVAPORATOR COIL", the disclosure of which is incorporated herein, in its entirety, by reference.

FIELD

The described embodiments relate to systems and methods for providing resistive and electromagnetic heating for defrosting or deicing an evaporator coil.

BACKGROUND

During the operation of a refrigeration system such as a refrigerator or an air conditioner unit, cooling may be accomplished by cycling a refrigerant liquid through a heat exchanger system in which the refrigerant liquid is allowed to evaporate as it passes through an evaporator coil located in the environment being cooled. During, the process of evaporation, heat energy surrounding the evaporator coil may be absorbed by the refrigerant liquid thereby reducing the temperature of the surrounding environment. The evaporated refrigerant can then be cycled to a compressor located away from the environment being cooled to be compressed back to a liquid (which disperses the energy absorbed by the liquid as heat) so that the refrigerant liquid can be recycled back into the evaporator coil for further cooling.

As a result of the cooling effect of the refrigerant evaporation process, the temperature at the surface of the evaporator coil may also be reduced. The reduction in the surface temperature of the evaporator coil may fall below the dew point of the air surrounding the coil, causing moisture in the air to condense onto the evaporator coil. In some cases, such as in the operation of a freezer unit, the temperature of the evaporator coil may fall below 0° C. causing the condensed water on the evaporator to freeze, producing frost on the surface of the evaporator coil.

The presence of frost on the surface of the evaporator coil negatively impacts the cooling process by reducing the efficiency by which the refrigerant liquid absorbs heat within the evaporator coil as it evaporates. Over time, the build-up of additional frost on the surface of the evaporator coil further impacts the performance of the refrigeration system. As such it may be desirable to have a system and a method in which the build-up of frost may be minimized or eliminated.

SUMMARY OF VARIOUS EMBODIMENTS

In a broad aspect, at least one embodiment described herein provides a method of configuring an evaporator coil. The method involves providing a refrigerant tube formed from an electrically conductive material, an upstream refrigerant conduit for supplying a refrigerant to the refrigerant tube, and a downstream refrigerant conduit for receiving the refrigerant from the refrigerant tube; determining at least one of a desired resistive heating and electromagnetic heating for defrosting the refrigerant tube; providing an electrical coupler, connectable to a standard line voltage from an external power source, the standard line voltage having an externally determined voltage value and an externally determined standard line frequency; determining at least one parameter of the refrigerant tube; based on the at least one parameter of the refrigerant tube, determining a target frequency of a high-frequency alternating current to apply to the refrigerant tube to provide the at least one of the desired resistive heating and electromagnetic heating when the high-frequency alternating current is applied to the refrigerant tube, the target frequency being higher than the externally determined standard line frequency; and configuring and providing an electronic circuit electrically connectable between the standard line voltage and the refrigerant tube to receive and transform the standard line voltage to provide the high-frequency alternating current at the target frequency in the refrigerant tube, the target frequency being higher than an externally determined frequency of the externally determined voltage.

In some embodiments, the method involves determining the target frequency of the high-frequency alternating current to apply to the refrigerant tube comprises determining a target resistance of the refrigerant tube for providing the at least one of the desired resistive heating and electromagnetic heating for defrosting the refrigerant tube when the refrigerant tube is connected to the standard line voltage, and then adjusting the target frequency to provide the target resistance.

In some embodiments, the at least one parameter of the refrigerant tube comprises at least two of an electrical resistivity of the refrigerant tube, a relative magnetic permeability of the refrigerant tube and a magnetic loss obtainable from the refrigerant tube; and determining the target frequency of the high-frequency alternating current applied to the refrigerant tube to provide the target resistance to the refrigerant tube comprises determining the at least two of: the electrical resistivity of the refrigerant tube; the relative magnetic permeability of the refrigerant tube; and the magnetic loss obtainable from the refrigerant tube; and based on the at least two of the electrical resistivity, the magnetic permeability and magnetic loss, determining the target frequency of the alternating current to apply to the refrigerant tube to provide the target resistance in the refrigerant tube.

In some embodiments, the at least one parameter of the refrigerant tube comprises an electrical resistivity of the refrigerant tube, a relative magnetic permeability of the refrigerant tube and a magnetic loss obtainable from the refrigerant tube; determining the target frequency of the high-frequency alternating current applied to the refrigerant tube to provide the target resistance to the refrigerant tube comprises determining the electrical resistivity of the refrigerant tube; determining the relative magnetic permeability of the refrigerant tube; determining the magnetic loss obtainable from the refrigerant tube; and based on the electrical resistivity, the magnetic permeability and magnetic loss, determining the target frequency of the alternating current to apply to the refrigerant tube to provide the target resistance in the refrigerant tube.

In some embodiments, the method involves providing the refrigerant tube formed from the electrically conductive material comprises determining a minimum relative magnetic permeability, and then selecting the electrically conductive material such that the relative magnetic permeability of the electrically conductive material exceeds the minimum relative magnetic permeability.

In some embodiments, the selected electrically conductive material has a relative magnetic permeability of higher than 40.

In some embodiments, the selected electrically conductive material has a relative magnetic permeability of higher than 700.

In some embodiments, the method involves configuring the electronic circuit to output the target frequency to provide a power dissipation density due to the at least one of the resistive heating and electromagnetic heating at the refrigerant tube of at least 0.2 kW per square meter of the refrigerant tube surface area.

In some embodiments, the method involves configuring the electronic circuit to output the target frequency to provide a power dissipation density due to the at least one of the resistive heating and electromagnetic heating at the refrigerant tube of at least 1 kW per square meter of the refrigerant tube surface area.

In some embodiments, the target frequency is between 1 kHz and 250 kHz. In another broad aspect, at least one embodiment described herein provides an evaporator. The evaporator comprises: a refrigerant tube providing an electrical path and a heat transfer surface, the electrical path being formed of an electrically conductive material having a relative magnetic permeability higher than 40 and being in thermal communication with the heat transfer surface to transfer heat to the heat transfer surface; an upstream refrigerant conduit for supplying a refrigerant to the refrigerant tube; a downstream refrigerant conduit for receiving the refrigerant from the refrigerant tube; an upstream electrical isolation element for electrically isolating the refrigerant tube from the upstream refrigerant manifold; a downstream electrical isolation element between the refrigerant tube and the downstream refrigerant manifold; an electrical coupler connectable to a standard line voltage from an external power source, the standard line voltage having an externally determined voltage value and standard line frequency; and an electronic circuit electrically connectable between a standard line voltage and the refrigerant tube, in operation the electronic circuit receiving and transforming the standard line voltage to provide a high-frequency alternating current at a target frequency in the refrigerant tube, most of the high-frequency alternating current being provided in the electrical path, and the target frequency being higher than an externally determined frequency of the externally determined voltage; wherein a total resistance obtained from applying the high-frequency alternating current to the electrical path of the refrigerant tube is at least 1.5 times a notional resistance obtainable from providing a direct current to the electrical path of the refrigerant tube.

In some embodiments, the refrigerant tube may be formed from the electrically conductive material having the relative magnetic permeability higher than 40.

In some embodiments, the electrical path may comprise an external layer of the refrigerant tube, the external layer being formed of the electrically conductive material and the heat transfer surface being an outer surface of the external layer; and the refrigerant tube further comprises a metal having a relative magnetic permeability lower than 40.

In some embodiments, the evaporator may further comprise external fins attached to the heat transfer surface of the refrigerant tube, wherein the electrical path may comprise an internal layer of the refrigerant tube, the internal layer being formed of the electrically conductive material; the electronic circuit comprising a coaxial cable to complete the electronic circuit by carrying the high-frequency alternating current in an opposite direction of a flow of the high frequency alternating current in the internal layer of the refrigerant tube; and the refrigerant tube further comprises a metal having a relative magnetic permeability lower than 40 for conducting heat from the internal layer to the heat transfer surface.

In some embodiments, the electronic circuit provides, when connected to the standard line voltage, an electrical connection between the standard line voltage and the refrigerant tube, such that the electrical connection comprises at least one electrical pathway that is not filtered to remove line voltage pulsations.

In some embodiments, the relative magnetic permeability of the refrigerant tube material is higher than 700.

In some embodiments, the evaporator tube material is an alloy mostly comprising at least one of magnetic stainless steel, structural steel, carbon steel, Si steel, and nickel.

In some embodiments, at least a portion of the refrigerant tube comprises a plurality of parallel current flow paths for carrying the alternating current to create an inductance; and during operation, the plurality of parallel current flow paths comprises alternating current flowing in opposite directions such that an impedance associated with the inductance is less than five times that of a resistance obtainable in the plurality of parallel current flow paths.

In some embodiments, during operation, a range of current densities between a minimum current density and a maximum current density is determinable in the plurality of parallel current flow paths, by defining a plurality of cross-sections along most of a length of the plurality of parallel current flow paths, and, for each cross-section in the plurality of cross-sections, determining a corresponding current density; and each parallel current flow path in the plurality of parallel current flow paths is separated from another parallel current flow path by a minimum distance such that a ratio of the maximum current density to the minimum current density is less than 3.

In some embodiments, for each current flow path in the plurality of parallel current flow paths, the plurality of parallel current flow paths comprises an associated closest current flow path such that no other current flow path in the plurality of parallel current flow paths is closer to that current flow path than the associated closest current flow path; and during operation, the alternating currents in that current flow path and its associated closest current flow path flow in opposite directions.

In some embodiments, the generated power dissipation density due to at least one of actual resistive heating and electromagnetic heating at the target frequency is at least 0.2 kW per square meter of the refrigerant tube.

In some embodiments, the generated power dissipation density due to at least one of actual resistive heating and electromagnetic heating at the target frequency is at least 1 kW per square meter of the refrigerant tube.

In some embodiments, the electronic circuit comprises an oscillating element configured to provide the high-frequency alternating current at least in the frequency range between 1 kHz and 250 kHz.

In some embodiments, the electronic circuit electrically isolates the refrigerant tube from the external power source.

In some embodiments, the electronic circuit comprises an AC rectifier for converting the standard line voltage to a constant polarity pulsating waveform, and without filtering to remove pulsations, connects the constant polarity pulsating waveform directly to a high-frequency AC generator for converting the constant polarity pulsating waveform to the high-frequency alternating current at the target frequency.

In some embodiments, the electronic circuit may comprise a stopper filter, the stopper filter comprising an inductor connected in series between the standard line voltage and the refrigerant tube, and a capacitor connected in parallel with the refrigerant tube.

In some embodiments, at least 5% of the actual resistance obtained from applying the high-frequency alternating current to the refrigerant tube is attributable to a resistance associated with a magnetic loss obtainable from the refrigerant tube.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

A preferred embodiment of the present invention will now be described in detail with reference to the drawings, in which.

DETAILED DESCRIPTION OF EXEMPLARY EMBODIMENTS

Figure 1:
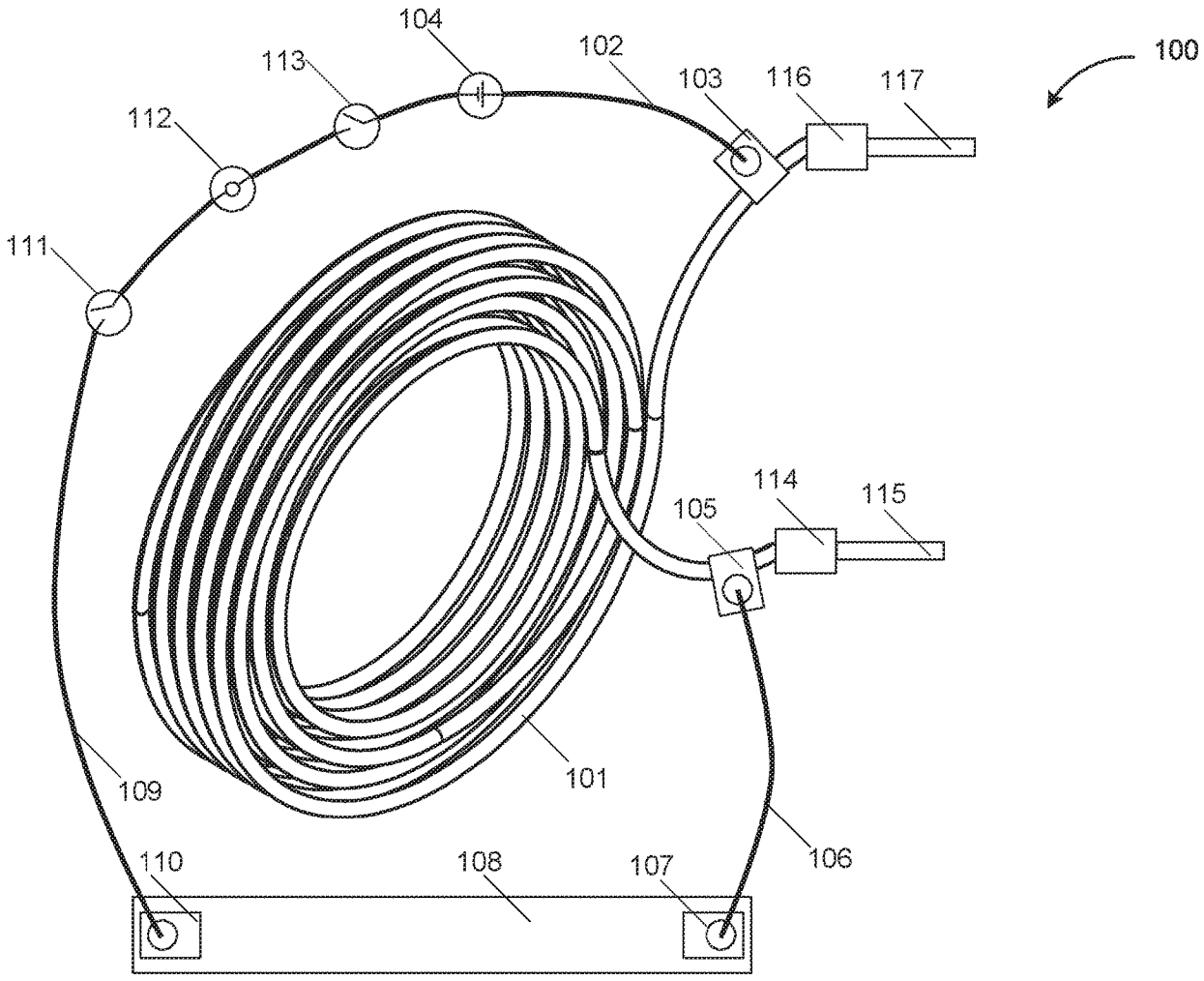
FIG. 1 is a diagram of a diagram of an evaporator system in accordance with at least one example embodiment.

Various embodiments in accordance with the teachings herein will be described below to provide an example of at least one embodiment of the claimed subject matter. No embodiment described herein limits any claimed subject matter. The claimed subject matter is not limited to devices or methods having all of the features of any one of the devices or methods described below or to features common to multiple or all of the devices and or methods described herein. It is possible that there may be a device or method described herein that is not an embodiment of any claimed subject matter. Any subject matter that is described herein that is not claimed in this document may be the subject matter of another protective instrument, for example, a continuing patent application, and the applicants, inventors or owners do not intend to abandon, disclaim or dedicate to the public any such subject matter by its disclosure in this document.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation of the modified term such that the end result is not significantly changed. These terms of degree may also be construed as including a deviation of the modified term if this deviation would not negate the meaning of the term it modifies.

Furthermore, the recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 10%, for example.

The efficient operation of a refrigeration system generally relies on the performance of the evaporator coil, which carries refrigerant liquid in the heat exchange unit to capture excess heat in the environment being cooled. Frost may build up on the surface of the evaporator coil during the operation which can reduce the efficiency of the refrigeration system.

A system and method to provide a self-defrosting evaporator coil using high-frequency alternating current (AC) is presented herein. The system may be configured to operate using voltages corresponding to conventional power line voltages applied to an evaporator coil with a known magnetic permeability to obtain the desired resistive and/or electromagnetic heating for defrosting the coil.

For the purpose of the present disclosure, the terms "defrosting" and "deicing" may be used interchangeably to refer to the removal of the buildup of ice on a surface.

High-Frequency Alternating Current Resistive and/or Electromagnetic Heating

FIG. 1 is a diagram of an embodiment of an evaporator system 100. The evaporator comprises a refrigerant tube 101 to carry the refrigerant liquid. In the present embodiment, the refrigerant tube 101 is shaped in a helical fashion, although it would be understood that the refrigerant tube may be shaped in any other desirable manner to maximize the surface area for optimal refrigeration.

A fluid conduit may be used to direct refrigerant fluid between the refrigerant tube to/from a compressor component (not shown) of the refrigeration system. It should be noted that the conduit used for manipulating the flow of liquid may have a single or multiple directing outlets, depending on the desired flow control. In circumstances in which an electrical signal is applied to the refrigerant tube, electrical separation between the refrigerant tube and the rest of the evaporator system may be desirable. In the present embodiment, the conduit may be a dielectric union. Specifically, the first end of the refrigerant tube may be coupled to an inlet refrigerant tube 115 carrying refrigerant liquid from the compressor (not shown) via a first dielectric union 114 as the conduit. The second end of the refrigerant tube may be coupled to an outlet refrigerant tube 117 carrying evaporated refrigerant to the compressor via a second dielectric union 116.

Electrical wires may be used to provide electrical connections for resistive or electromagnetic heating of the refrigerant coil. In the present embodiment a first wire segment 102 can be used to connect power provided to an alternating current (AC) supply connector 104 to the refrigerant tube 101 via a first electrical clamp 103 at the second end of the refrigerant tube. The first wire segment may be connected to a third wire segment 109 to a drip pan 108 via a fourth electrical clamp 110, in which the drip pan 108 may be connected, via a third electrical clamp 107, to the first end of the refrigerant tube through a second wire segment 106 and a second electrical clamp 105. This connection in series of the first wire segment, the first electrical clamp, the refrigerant tube, the second electrical clamp, the second wire segment, the third electrical clamp, the drip pan, the fourth electrical clamp, and the third wire segment may provide an electrical circuit or electrical path.

Along the first wire segment, an interlock switch 113 may be installed to allow manual disconnection of the electrical circuit (e.g. by unplugging the interlock) to allow access to the refrigerant coil upon opening the evaporator cover. A fuse link 112 comprising a temperature sensitive thermal fuse may also be installed such that the electrical circuit may be disconnected upon the resistive or electromagnetic heating exceeding a threshold temperature. A switch 111 may be installed between the first wire segment 102 and third wire segment 109 to control (i.e. initiate and terminate) the defrost cycle.

In some cases, it may be desirable to supply single-phase or three-phase line voltage (e.g. 120V or 240V) or a similarly high voltage to the refrigerant tube 101 for defrosting purposes since doing so may avoid having to include an expensive and heavy step-down or brick transformer in the evaporator system. Generally, a refrigerant tube resistance of at least 5Ω may be required to permit a connection to the line voltage without a transformer to obtain resistive heating. Inclusion of the drip pan 108 connected in series with the refrigerant tube may be used to provide resistive heating for the drip pan as well. An appropriate total resistance of the refrigerant coil may avoid drawing too much current (e.g. maximum allowable current in a house hold would be around 12 A) from the power supply, yet be able to draw an appropriate current from the power supply via AC supply connector 104 for a total power dissipation enough for a defrosting power density of at least 0.2 $kW/m^2$ but preferably 1 $kW/m^2$ or higher within the refrigerant tubing. The requirements to obtain such a total resistance may limit construction of the refrigerant tube to certain materials, for example, to those with a specific range of resistivity of at least $4\times10^{-7}$ Ω·m, as well as certain range of tube wall thicknesses (usually not more than 0.15 mm).

Such limitations may be avoided by applying a high-frequency voltage to the refrigerant tube 101 and leveraging the following well-known electromagnetic effects to alter the total resistance of the tube material: skin effect and magnetic losses. In other words, application of a high-frequency voltage may permit increasing, on demand, the resistance of a refrigerant coil 101 by controlling the current and frequency using the combination of skin effect and magnetic loss as explained further in subsequent paragraphs. In doing so, a higher voltage may be provided to the refrigerant tube 101 thereby simplifying the components required for defrosting.

In addition to the above identified skin effect and magnetic losses, it may also be important to consider two additional effects: the "proximity effect" and the overall inductance of the evaporator coil as a high-frequency voltage is applied. These two additional effects may impact the current drawn by the refrigerant tube 101 and may warrant certain design considerations. For example, these effects can be limited by bending the refrigerant coil to provide opposing current flows in adjacent tubes or by using a thin copper wire carrying return current in opposite direction and parallel to the tubes of the evaporator coil as discussed in more detail below.

Skin Effect

Skin effect may be described as the tendency of an alternating electric current (AC) to become distributed within a conductor such that the current density is largest near the surface of the conductor, and decreases with greater depths in the conductor. As such, the electric current may be said to flow mainly at the "skin" of the conductor, between the outer surface and a level called the "skin depth". The skin effect may cause the effective resistance of the conductor to increase at higher frequencies where the skin depth is smaller, thus reducing the effective cross-section of the conductor. The skin effect may cause the current to flow in an electrical path defined by the cross-sectional "skin depth" diameter extending the length of the conductor. The skin effect may be produced by opposing eddy currents induced by the changing magnetic field resulting from the applied alternating current. Additional details with regards to the relationship between the skin effect and frequency is described in this section.

The AC current density, J, in a conductor may decrease exponentially from the current density at the surface, $J_s$, according to the depth, d, away from the surface. This relationship may be described as follows:

$$J=J_s e^{-d/\delta} \tag{1}$$

where δ is referred to as the skin depth. The skin depth may thus be defined as the depth below the surface of the conductor at which the current density has fallen to 1/e (about 0.37) of $J_s$. The general formula for the skin depth may be expressed as:

$$\delta = \sqrt{\frac{2\rho}{\omega\mu}}\sqrt{\sqrt{1+(\omega\rho\epsilon)^2}+\rho\omega\epsilon} \tag{2}$$

where ρ is the resistivity of the conductor, ω is the angular frequency of current (ω=2πf), f is the frequency, μ is the magnetic permeability ($\mu=\mu_r\mu_0$), $\mu_r$ is the relative magnetic permeability of the conductor, $\mu_0$ is the permeability of free space ($1.25663706\times10^{-6}$ H/m), ϵ is the permittivity ($\epsilon=\epsilon_r\epsilon_0$), $\epsilon_r$ is the relative permittivity of the material, $\epsilon_0$ is the permittivity of free space ($8.85418782\times10^{-12}$ F/m). It will be apparent subsequently that in the frequency range of interest, which is described further below, the first factor of equation 2 may be of consideration because the second factor may be close to 1 or unity.

The high frequency electrical resistance of a refrigerant coil due to the skin effect at frequency f may be calculated as follows:

$$R_{se} = \frac{\rho_e L}{2\pi\delta^2\left[\left(\frac{d_{out}}{2\delta}-1\right)-e^{-t_\omega/\delta}\left(\frac{d_{out}-2t_\omega}{2\delta}-1\right)\right]} \tag{3}$$

where $\rho_e$ is the electrical resistivity of the coil material, L is the coil length, $d_{out}$ is the outside diameter of the tube used to make the coil, and $t_w$ is the wall thickness of the tube used to make the coil. This resistance can be compared to the (notional) resistance of the coil observable in the presence of a DC current that can be calculated as:

$$R_{DC} = \frac{4\rho_e L}{\pi[d_{out}^2-(d_{out}-2t_\omega)^2]} \tag{4}$$

It may be worth noting that the skin effect is a function of both frequency and current because the magnetic permeability in equation 2 is a function of the magnetic field generated by the current. Similarly, resistance due to the skin effect may also vary as a function of both frequency and current.

Magnetic Losses

Magnetic losses can be explained by considering a ferromagnetic material with a given hysteresis curve exposed to an oscillating magnetic field at low frequencies. In this context, two mechanisms may be associated with magnetic losses. First, the changing magnetic field may induce so-called eddy currents that wander around in the ferromagnetic material. Second, the movement of magnetic domain walls may require (and disperse) some energy, which may be categorized as intrinsic magnetic losses or hysteresis losses. The energy lost as a result of these mechanisms may be converted into heat. Furthermore, the quantities of these losses may increase as the frequency applied increases.

The heating power of the whole refrigerant tube due to magnetic losses at frequency f can be calculated as follows:

$$W_h=q\cdot fV_t \tag{5}$$

where q is the magnetic loss energy for one AC cycle per cubic meter and can be estimated using an approximation from the magnetization curve of the coil material using the relation $q=A_{st}B_{max}H_i$, in which $A_{st}$ is an experimentally-determined fitting coefficient for the given material, $B_{max}$ is the maximum density of magnetic flux in a hysteresis loop, $H_i$ is the magnetic field at the current I and may be calculated based on the relation $H_i=I/(\pi d_{out})$; and $V_t$ is the effective volume filled with magnetic field energy and can be calculated as $V_t=\pi L\delta d_{out}/2$.

The apparent electrical resistance of an evaporator due to the magnetic losses at current I can be calculated as follows:

$$R_{ml} = \frac{W_h}{I^2} \tag{6}$$

Figure 2A:
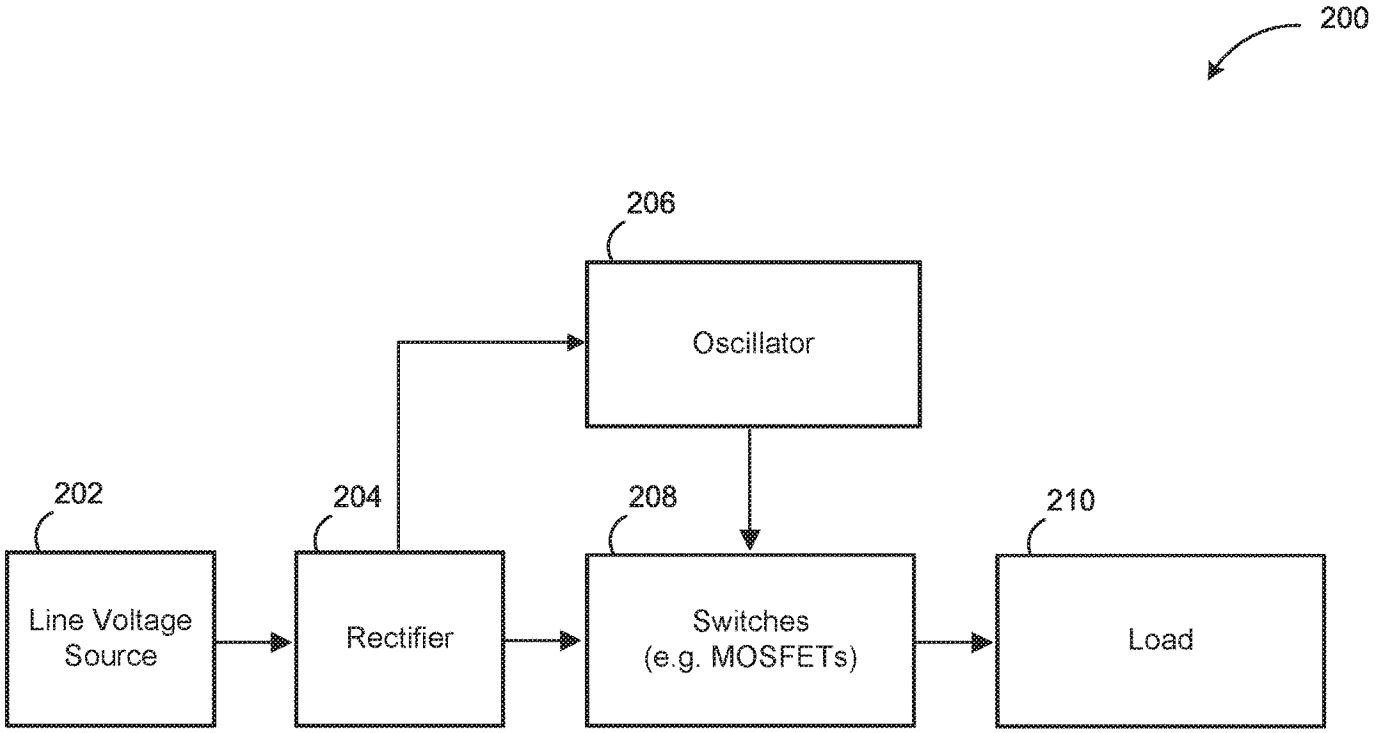
FIG. 2A a block diagram of a high-frequency defrosting system in accordance with at least one example embodiment.
Figure 2B:
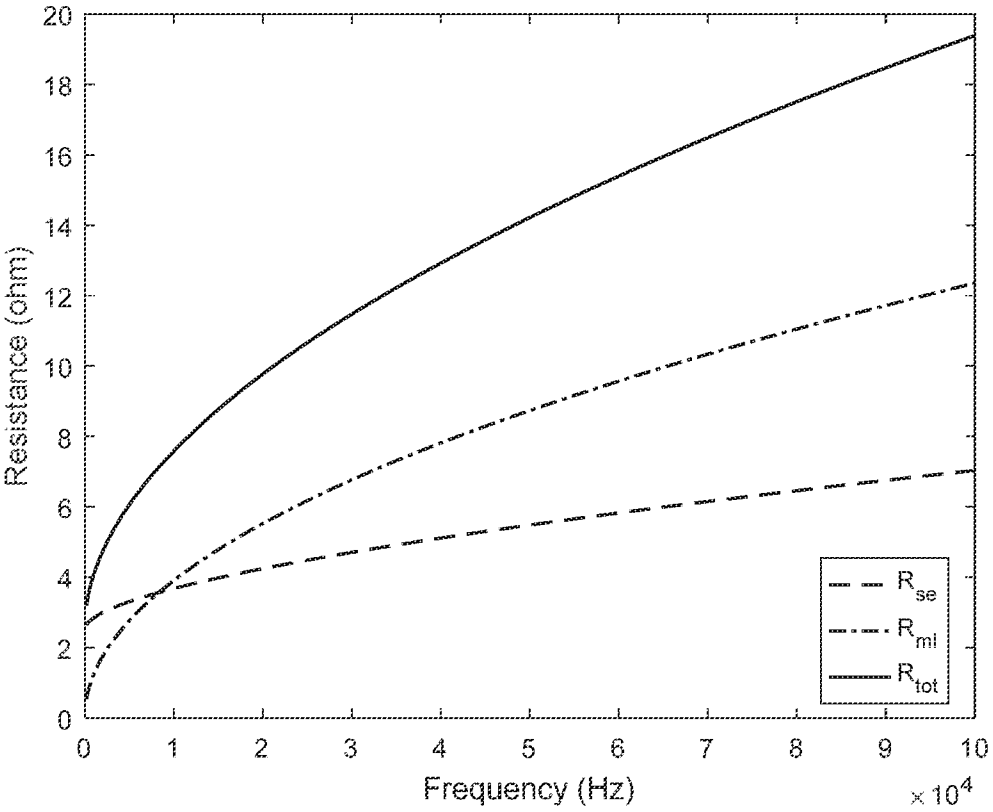
FIGS. 2B and 2C are graphs illustrating the total "apparent" resistance of a coil as a function of frequency and current, respectively, in accordance with at least one example embodiment.
Figure 2C:
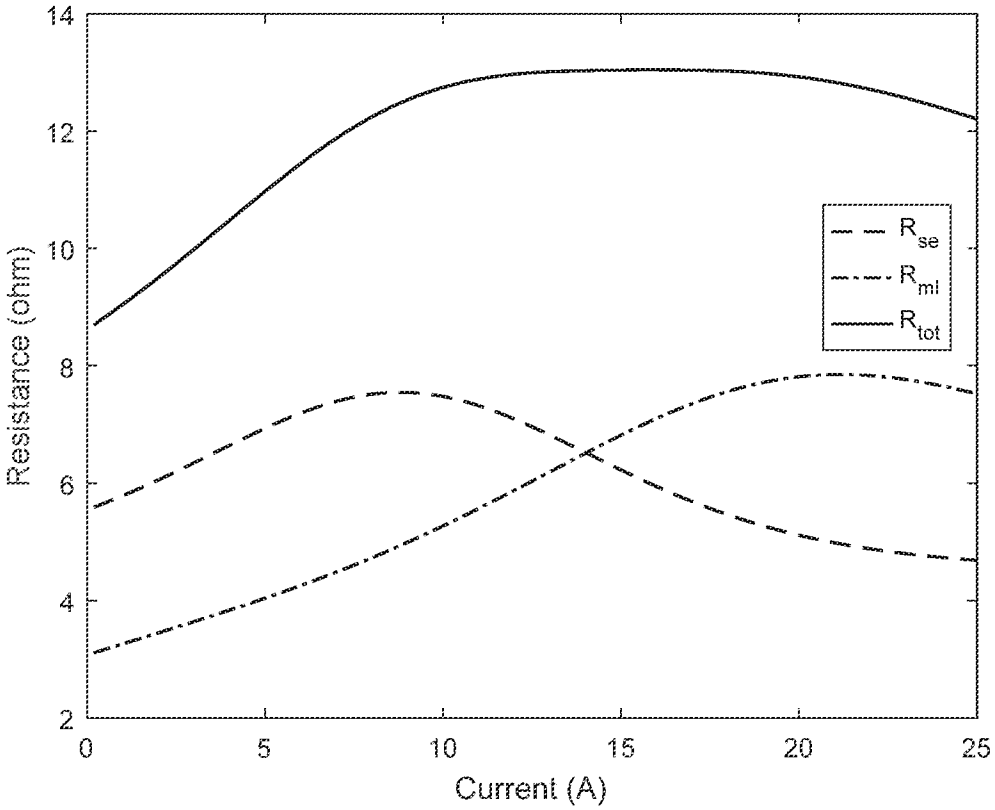

Similar to the skin effect, the magnetic losses may vary as a function of both frequency and current as shown in FIGS. 2B and 2C. Similarly, resistance due to magnetic losses may also vary as a function of both frequency and current. Therefore, the combined effect of both skin effect and magnetic losses can be maximized by optimizing both frequency selected and electric current passing through the coil. Even at low frequencies (e.g. 1 kHz), the apparent resistance due to magnetic loss may be more than 5% of the overall total resistance.

Proximity Effect

Proximity effect can be explained in the context of a conductor carrying an alternating current. In this situation, if the currents are flowing through one or more other nearby conductors, such as within a closely wound coil in which the current paths are generally parallel, the distribution of current within the first conductor may be constrained to smaller regions. The resulting current crowding can be called the "proximity effect". This crowding may provide an increase in the effective resistance of the circuit that increases with frequency. In other words, the proximity effect may increase as the frequency is increased. The proximity effect can significantly increase the AC resistance of adjacent conductors when compared to its (notional) resistance observable in the presence of a DC current. However, the proximity effect may also cause variability in current densities observable throughout in the coil which may be an additional consideration that will be discussed below.

The high frequency electrical resistance of an evaporator due to the proximity effect at frequency f can be calculated as follows:

$$R_{pe} = R_{DC}\left(\mathrm{Re}[\alpha h\coth(\alpha h)] + \frac{(m^2-1)\mathrm{Re}\left[2\alpha h\tanh\left(\frac{\alpha h}{2}\right)\right]}{3}\right) \tag{7}$$

where $R_{DC}$ is the DC resistance of the coil as calculated from equation 4, m denotes the number of layers, Re[ . . . ] is the real part of the expression in brackets, $a=\sqrt{2j\pi f\mu_0\eta/\rho_e}$, $\eta=N_l a/b$, $N_l$ is the number of turns per layer, a is the width of the conductor, b is the width of the winding window, and h is the height of the conductor.

Please note that equation 7 may apply to coil configurations similar to the helical coil as shown in FIG. 1 or other embodiments of coils where all the current in adjacent tubes flows in the same direction. However, such effect can be significantly reduced if the evaporator coil is configured in a manner so that the current in adjacent tubes flows in the opposite direction as will be in greater detail subsequently.

For the case in which a coil with parallel current paths is configured such that the flow of current is in the same direction in all of the parallel current paths, the total resistance at high-frequency $R_{HF}$ may expressed as:

$$R_{HF}=R_{se}+R_{pe}+R_{ml} \tag{8}$$

where $R_{se}$ (resistance due to the skin effect) may be calculated from equation 3, $R_{pe}$ (resistance due to the proximity effect) may be calculated from equation 7, and $R_{ml}$ (resistance due to magnetic loss) may be calculated from equation 6. This resistance may be compared to the original DC resistance (i.e. a notional resistance value) of the coil, $R_{DC}$, that can be calculated from equation 4. At higher frequencies, the total resistance, $R_{HF}$, may become significantly higher than the notional resistance, $R_{DC}$, due to the combined effects of skin effect, magnetic loss, and proximity effect as described above. For the case in which a coil with parallel current paths is configured such that the flow of current is in the opposite direction in adjacent parallel current paths, the proximity effect term in equation 8 can be significantly reduced.

Inductance and Impedance

Inductance may be viewed as the property of an electrical conductor by which a change in the current through the conductor induces an electromotive force in both the conductor itself and in any nearby conductors by mutual inductance. The inductance of an evaporator coil may depend on the configuration of the coil as will be explained further below. In general, a higher inductance value may increase the inductive reactance of the conductor, in particular, at high frequency. Hence, the total impedance of the coil may increase due to the inductive reactance such that the power factor (i.e. the ratio of the total resistance to the total impedance) may decrease. If the power factor falls to a value that is less than one, more current may have to be supplied to the evaporator coil, as compared to a coil with a higher power factor, to maintain the same amount of power use. As such, it may be preferable to obtain a power factor of one or "unity power factor".

The total inductance of the coil may depend on the configuration of the coil as will be shown subsequently for different coil configurations. For the case of a coil in which it is configured such that all the current in adjacent tubes flows in the opposite direction, the total inductance of the coil can be calculated as:

$$L_c \cong L_{tm} + L_{air} = \frac{2U}{I^2} + \frac{\mu_0 L}{\pi}\ln\left(\frac{2(d_{out}+gap)}{d_{out}}\right) \tag{9}$$

where $L_{tm}$ is the part of the tube inductance due to tube magnetization, $L_{air}$ is the inductance due to the magnetic field in air, U is the total maximum magnetic energy stored inside the tube, and gap is the separation or gap between axial and radial layers of the coil.

For the case of a helical coil as shown in FIG. 1 or other embodiments where all the current in adjacent tubes flows in the same direction, the total inductance of the coil can be calculated as:

$$L_c \cong L_{tm} + L_{air} = \frac{2U}{I^2} + \frac{\mu_0 A N^2}{L} \tag{10}$$

where N is the number of turns, A is the cross-section area of the coil, and L is the length of the coil.

The inductive reactance of the coil at frequency f can be calculated as:

$$X_L=2\pi f L_c \tag{11}$$

Hence, the total impedance of the coil at frequency f can be calculated as:

$$Z_{HF}=\sqrt{X_L^2+R_{HF}^2} \tag{12}$$

A power factor can be defined as $P_f=R_{HF}/Z_{HF}$ which specifies the ratio of the total resistance $R_{HF}$ to the total impedance $Z_{HF}$.

As discussed previously, it may be preferable to avoid a low value for the power factor. In some cases, a capacitor of capacitance C can be added to the system to counteract the effect of increased inductance. The capacitive reactance at frequency f may be calculated by:

$$X_C = \frac{1}{2\pi f C} \tag{13}$$

The value of C may be selected to such that that $X_C=X_L$ at the selected frequency f. At that frequency, $Z_{HF}$ may be equal to $R_{HF}$ so that the power factor $P_f$ may be unity. However, in practice, the electronic circuitry that may be needed to raise the power factor to unity may not practical if the power factor is initially less than 0.2. In this case, a more practical solution to consider may involve changing the configuration of the coil itself, as discussed in more detail below to minimize inductive reactance.

Based on the discussion presented above, by taking advantage of each of above identified effects (skin effect, magnetic loss, proximity effect and inductance), a high-frequency defrosting system that avoids limitation of the minimum length or maximum tube wall thickness may be possible.

Reference is now made to FIG. 2A, which is a block diagram of a high-frequency defrosting system 200 comprising system components in accordance with at least one example embodiment. Such a system may be implemented to take advantage of the above identified effects for defrosting a refrigerant tube. The system components can comprise at least a line voltage source 202, a rectifier 204, an oscillator circuit 206, switches 208 and a load 210.

The line voltage source 202 can provide the power used to obtain the resistive or electromagnetic heating. As the name of this component suggests, the voltage supplied by the line voltage source 202 is a line voltage or a reduced voltage obtained by an optional voltage controller (e.g. dimmer) connected to the line voltage. The voltage value of the line voltage may be determined by the power generating authority in the jurisdiction in which the high-frequency defrosting system 200 operates. For example, in Canada or the United States of America, the line voltage may be 120V AC at 60 Hz. In other jurisdictions, such as Germany, the line voltage may be 220V AC at 50 Hz. In either case, the line voltage may be further modified using a voltage controller. The rectifier 204 rectifies the AC voltage signal before it is provided to the switches 208. The oscillator 206 provides a high-frequency waveform to the switches 208. The switches 208 may then supply the high-frequency alternating current to the load 210 to obtain resistive and/or electromagnetic heating for defrosting purposes. The switches may be any suitable switching mechanism capable of operating at the desired frequency and current values. In some embodiments, the switches 208 may comprise transistors such as MOSFETs capable of operating at the desired frequency and current. Other types of switching mechanisms such as BJT switches may similarly be used. In the context of refrigeration systems, the load 210 in the present embodiment may be an evaporator coil as shown in FIG. 1, which can be a part of a heat exchanger unit within a larger refrigeration system. With reference to FIG. 1, the high-frequency alternating current may be supplied to the refrigerant tube at the AC supply connector 104.

While FIG. 2A depicts oscillator 206 and switches 208 being separate components, in some embodiments, the oscillator 206 and switches 208 may be combined into a single unit for receiving the input voltage and providing the high-frequency AC. For example, the combined electronic circuit may be fabricated as a single solid-state device to provide the desired resistive and/or electromagnetic heating.

In some embodiments, a ferromagnetic material (such as ferritic stainless steel, carbon steel, iron, . . . etc.) may be used to construct a refrigerant tube. Such materials have an intrinsic relative magnetic permeability value which may be taken into consideration to optimize frequency applied to the refrigerant coil so as to avoid increasing the complexity of the oscillator 206, which may operate in the frequency range between 1 kHz and 250 kHz. As such, a high-frequency defrosting system using such materials for the coil may avoid the limitations of the minimum length or maximum tube wall thickness. Specifically, applying a high-frequency voltage to a refrigerant tube of this type may restrict the flow of current to a thin layer on the outside of the tube, and hence allowing a controlled increase the tube resistance. Also, due to magnetic losses, the energy dissipation as heat may be significant at high frequencies, which in turn may further increase the apparent coil resistance as shown in equation 6. As will be explained by way of an example subsequently, where the relative magnetic permeability of the coil material is at low values, the determined frequency value required for the skin effect to produce the desired level of heating may be quite high (in the MHz to GHz range) which may require more complex circuitry. Therefore, it may be preferable to use ferromagnetic materials with a relatively high relative magnetic permeability. In some embodiments, the material may have a relative magnetic permeability higher than 40, and preferably higher than 700. Making use of such a material may enable a target frequency to be in the kHz range, such as 1 kHz to 250 kHz, so that the circuitry required to generate such a frequency may be obtained relatively easily and economically. Suitable materials may include metals or alloys comprising at least one ferromagnetic material including, but not limited to, magnetic stainless steel, structural steel, carbon steel, Si steel, and nickel. An additional characteristic of ferromagnetic materials is the magnetic loss which mainly depends on such parameters as $H_{coercive}$ and $B_{residual}$. Specifically, the coercivity, $H_{coercive}$, may be considered as the intensity of the applied magnetic field required to reduce the magnetization of that material to zero after the magnetization of the sample has been driven to saturation. Thus coercivity may be used to measure the resistance of a ferromagnetic material to becoming demagnetized. Residual magnetism, $B_{residual}$, may be considered the magnetization left behind in a ferromagnetic material after an external magnetic field is removed.

To illustrate how the choice of frequency may be affected through use of a ferromagnetic material, two scenarios are presented. In the first scenario, consider a coil made of material SS430 (with a relative magnetic permeability in the order of magnitude of 1000) with total length of 20 m made of a tube with outside diameter of 6.35 mm and tube wall thickness of 0.25 mm. Such coil may have a notional resistance (resistance at DC) of 2.5Ω, which may be too low for defrosting with a line voltage source since the resultant current would be too high (e.g. 120V/2.5Ω=48 A). On the other hand, using the high-frequency defrosting system as shown in FIG. 2A the current drawn may be reduced. For instance, the resistance of the coil in question may be doubled to 5Ω at 5 kHz (i.e. 120V/5Ω=24 A), further increased to 7.5Ω at 10 kHz (e.g. 120V/7.5Ω=16 A), or further increased to 10Ω at 20 kHz (e.g. 120V/10Ω=12 A). FIG. 2B is a graph illustrating the change in total "apparent" resistance ($R_{tot}$), electrical resistance due to magnetic losses ($R_{ml}$), and resistance due to the skin effect ($R_{se}$) may be generated from the equations above for a perfectly-annealed SS430 coil as a function of frequency at a current of 20 A (RMS). FIG. 2C is a graph illustrating the change in total "apparent" resistance ($R_{tot}$), electrical resistance due to magnetic losses ($R_{ml}$), and resistance due to the skin effect ($R_{se}$) generated from the equations above for a perfectly-annealed SS430 coil as a function of current at a frequency of 40 kHz. The illustrated graphs suggest that the overall resistance depends on both frequency and current, which may be taken into account as design parameters.

In the second scenario, consider a coil made of copper, a material commonly used for refrigeration tubing, (with a relative magnetic permeability in order of magnitude of 1) with total length 20 m made of a tube with outside diameter of 6.35 mm and tube wall thickness of 0.25 mm. Such a coil may have a notional resistance of 0.07Ω, which may be too low for defrost with a line voltage source for the same reasons identified previously. The current drawn by the tube may again be reduced by using the high-frequency defrosting system as shown in FIG. 2A. However, in this case, to increase the resistance to 5Ω may require an AC frequency of 374 MHz, or to increase it to 10Ω the AC frequency may need to be greater than 1 GHz. Therefore, using a material with low relative magnetic permeability may significantly increase the cost and complexity of electronics needed to produce the applied AC voltage. Typically, in practice, operating or target frequencies greater than 250 kHz may significantly increase the cost and complexity of the required electronics.

Various Coil Configurations

Figure 3A:
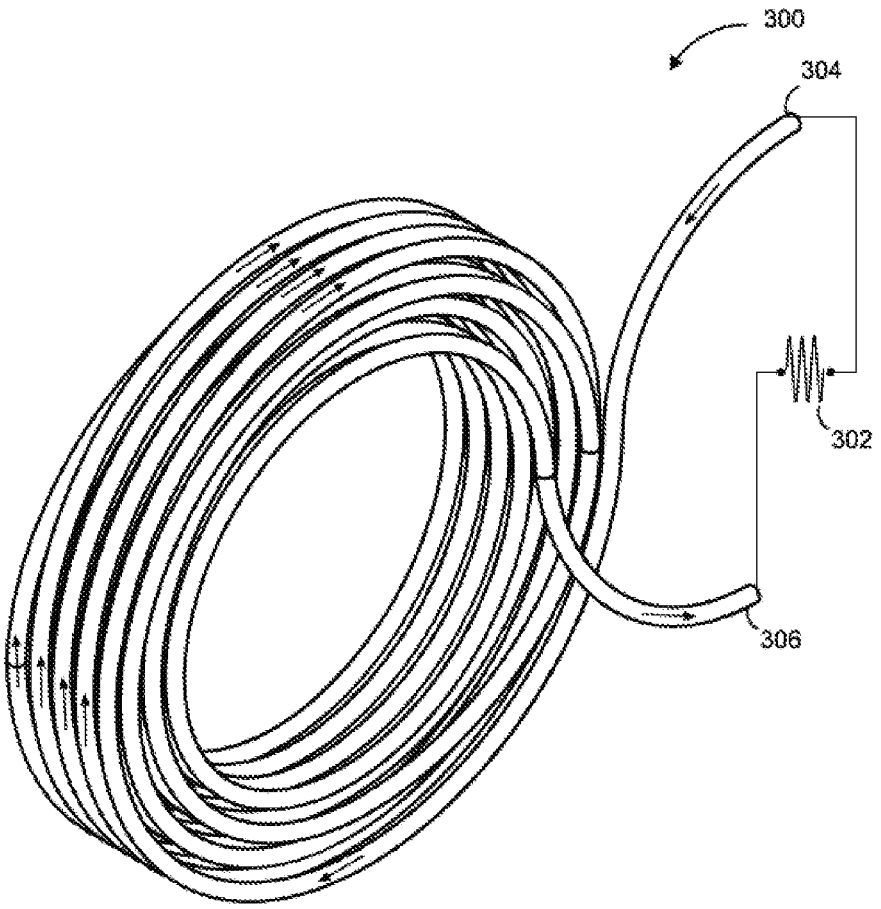
FIG. 3A is a diagram of a refrigerant tube in accordance with at least one example embodiment.

Reference is now made to FIG. 3A, which is a diagram of a refrigerant tube 300 in a helical configuration in accordance with an example embodiment. A high-frequency AC source 302 may be applied to the first end 304 and second end 306 such that current flow induced within the coil to flow between the first end 304 to the second end 306 as indicated by the arrows. The refrigerant tube of the present embodiment can make use of the skin effect and magnetic losses to increase the total resistance by optimizing both the frequency and current for defrosting applications. The configuration of the present embodiment may result in a series of adjacent parallel current paths in which the flow of current is in the same direction, as indicated by the arrows. Thus in the present embodiment, the proximity effect and impedance due to induction may be taken into account as discussed above. Specifically, the inductance of such a coil may be calculated using equation 10 described above. In some embodiments, the refrigerant tube may also have a different configuration, such as a cylindrical, a spiral, or a serpentine coil configuration. In these different configurations, similar use of the skin effect and magnetic losses may also be employed to increase the total resistance by optimizing both the frequency and current for defrosting applications.

Figure 3B:
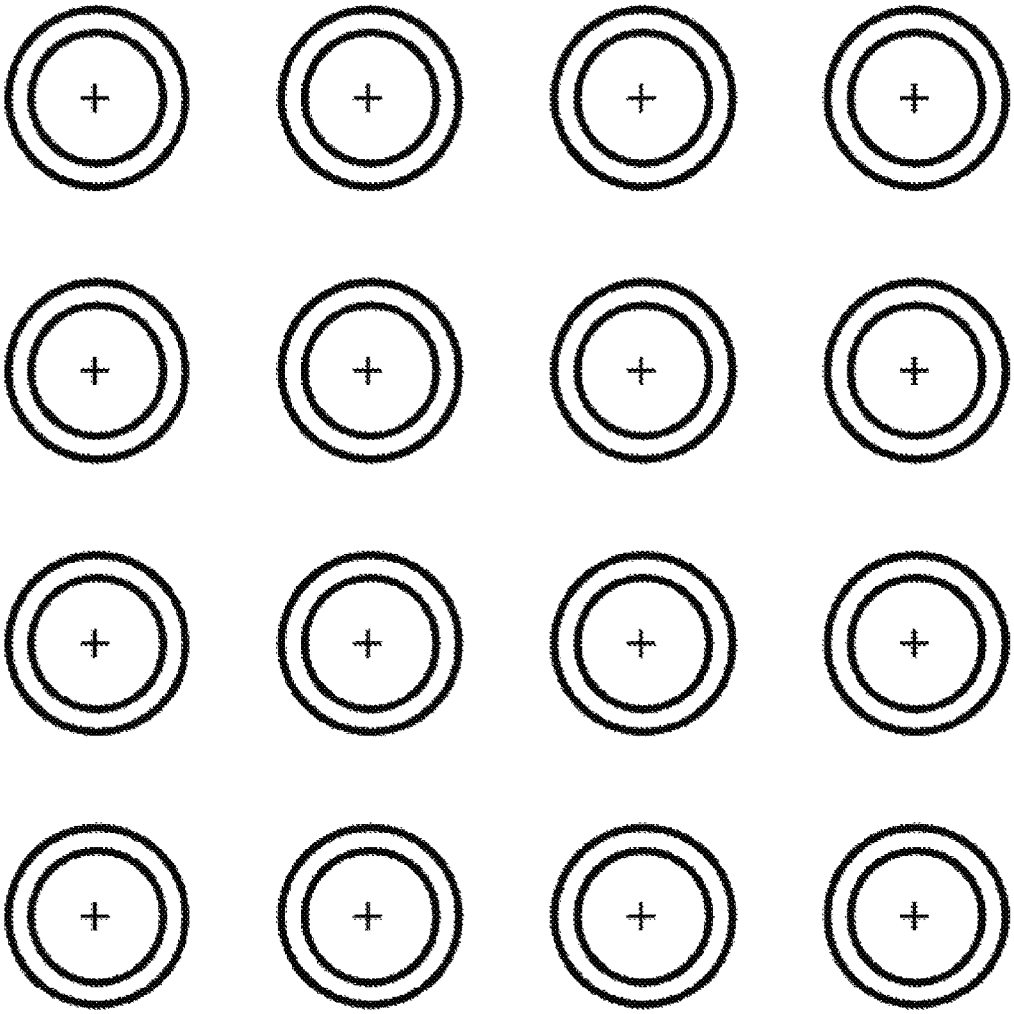
FIG. 3B is a cross-sectional view of the refrigerant tube of FIG. 3A.

Reference is now made to FIG. 3B, which is a cross-sectional view of refrigerant tube 300 in a helical configuration. In this case, current flow in each turn of the helical configuration may flow in the same direction as shown by the arrow (+) notation.

Figure 4A:
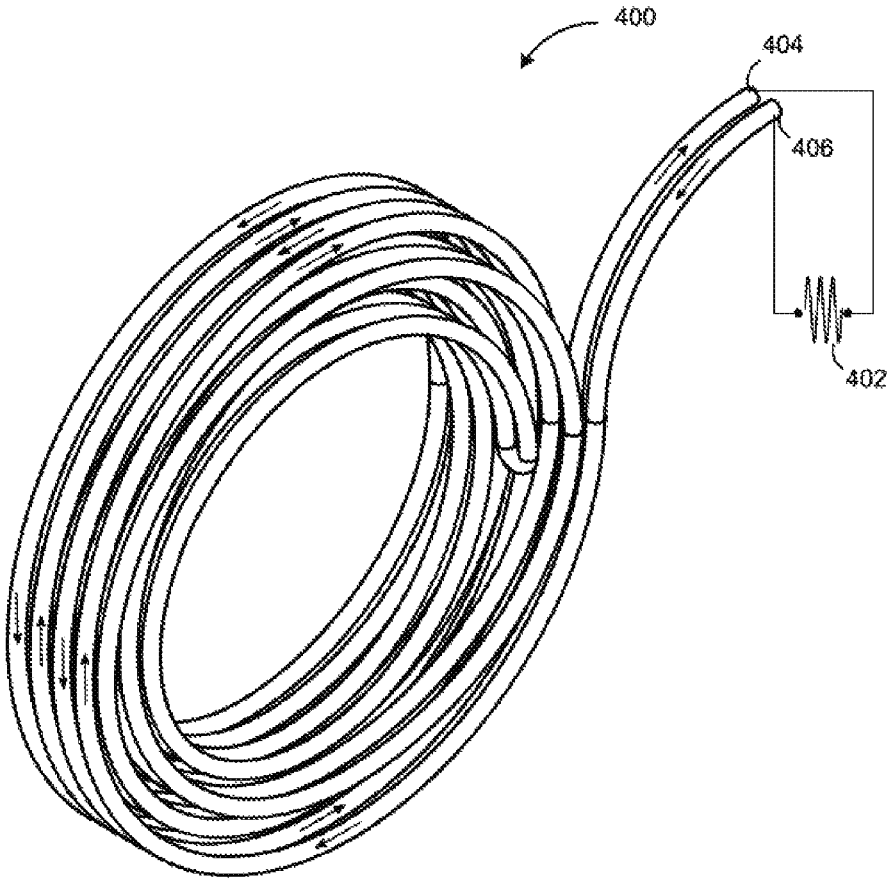
FIG. 4A is a diagram of a helically wound refrigerant tube in accordance with at least one example embodiment.

Reference is now made to FIG. 4A, which is a diagram of a refrigerant tube 400 in a helical configuration in accordance with at least one embodiment. A high-frequency AC source 402 may be applied to the first end 404 and second end 406 such that current flow induced within the coil to flow between the first end 404 to the second end 406 as indicated by the arrows. Specifically, refrigerant tube 400 of FIG. 4A may be regarded as a different variation of the refrigerant tube of FIG. 3A. The main difference between them is that refrigerant tube 400 is double wound together in a helical manner. Where an electrical connection is established in the manner described, the current flowing within adjacent tubes may flow in opposite directions, as indicated by the arrows. Such coil winding may be referred to as bifilar winding. Such a winding configuration may produce opposing current flows in the closest tubes belonging to neighboring tube layers.

Figure 4B:
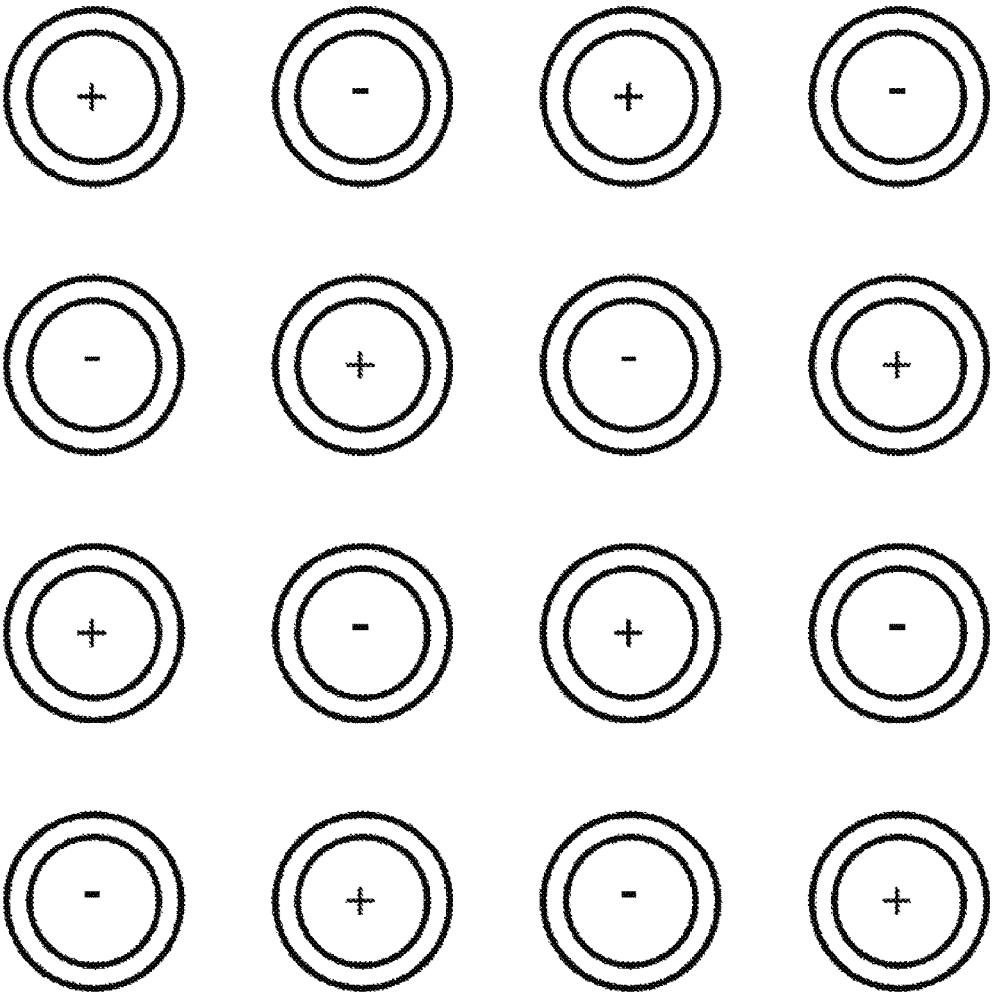
FIG. 4B is a cross-sectional view of the refrigerant tube of FIG. 4A.

Reference is now made to FIG. 4B, which is a cross-sectional view of refrigerant tube 400 in a bifilar winding configuration. In this case, current flow in neighboring tube layers may be in opposite directions. Additionally, the total current traversing the cross-section of the tubing may be zero as shown (i.e. flow denoted by "+" and "−" cancel out).

Referring back to FIG. 4A, similar to the embodiment of FIG. 3A, refrigerant tube 400 may also make use of the skin effect and magnetic losses to increase the total resistance by optimizing both the frequency and current. In the present embodiment, the proximity effect may be reduced as a result of the opposing flow of current. The inductance of such a coil may also be reduced and can be calculated using equation 9.

Figure 5A:
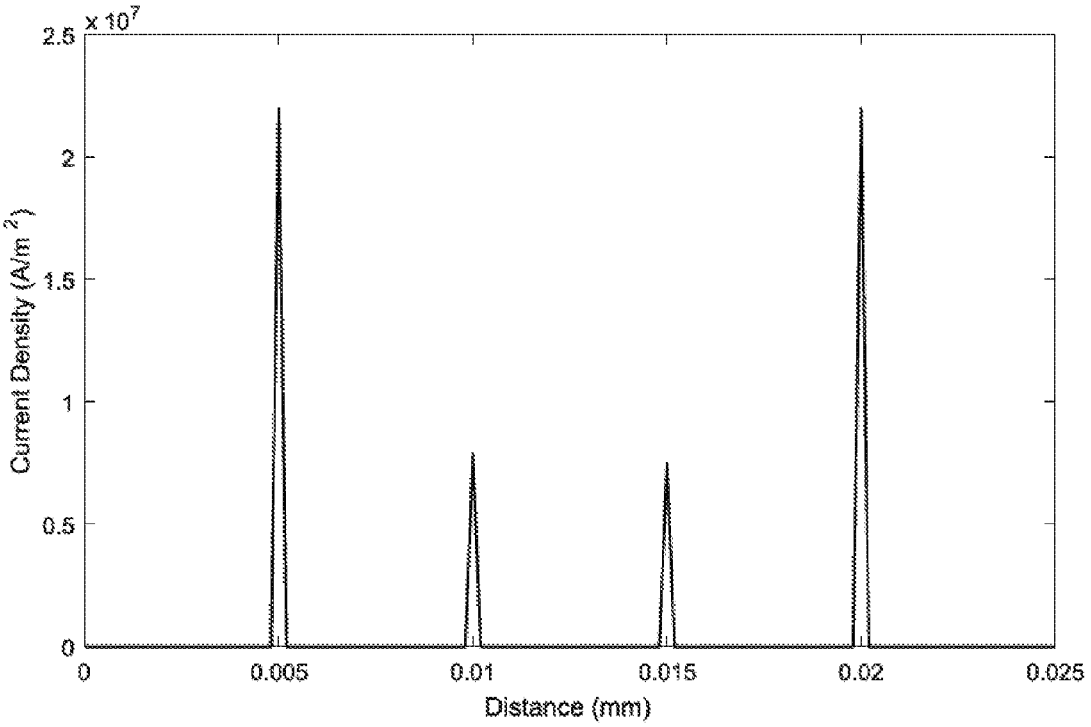
FIG. 5A is a graph showing the current densities across the line in FIG. 5B of a refrigerant tube in accordance with at least one example embodiment.
Figure 5B:
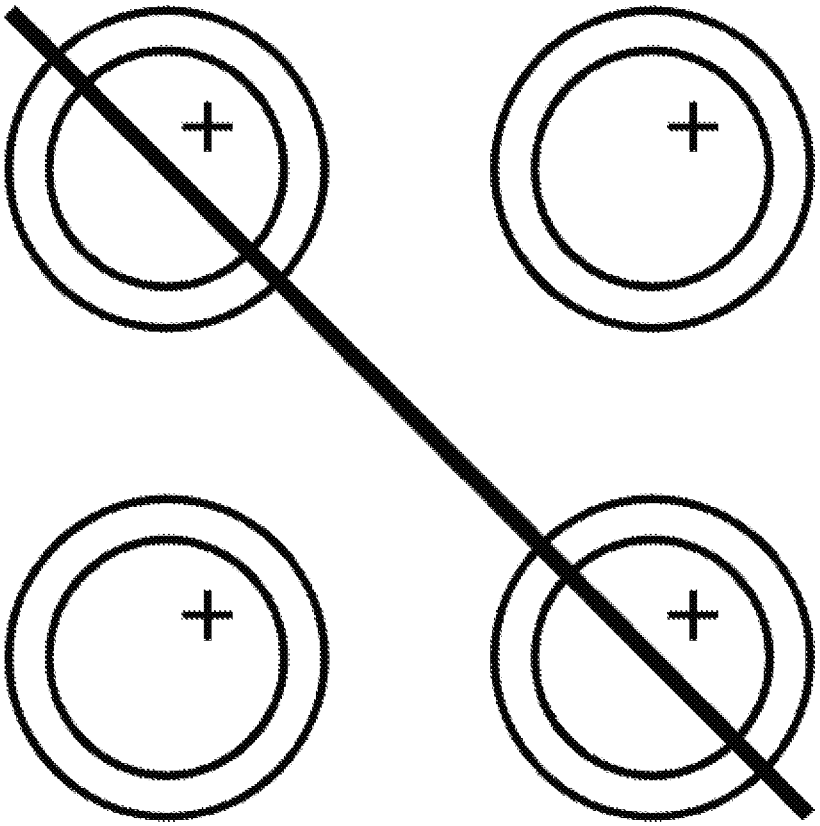
FIG. 5B is a cross-sectional view of a refrigerant tube in accordance with at least one example embodiment.

The impact of the proximity effect for a coil configuration similar to the one described in FIG. 3A, in which multiple parallel current flow paths carry current flowing in the same direction may be significant. Specifically, the proximity effect may produce significant variability in the current density at different positions throughout the coil, as shown in FIG. 5A. In the present embodiment, the current density may be measured along most of the tube in which there are parallel current paths. The currents at various joints (e.g. at the positions of the conduits or dielectric unions) may be ignored since the current densities measured would be variable and skew the impact of the proximity effect. Specifically, FIG. 5A provides the current density as a function of distance, showing that the current density may vary from a minimum of $0.8\times10^7$ A/m$^2$ on one part of the tube to a maximum of $2.2\times10^7$ A/m$^2$ on the opposite part of the tube, representing a maximum to minimum ratio of 2.75.

Figure 6A:
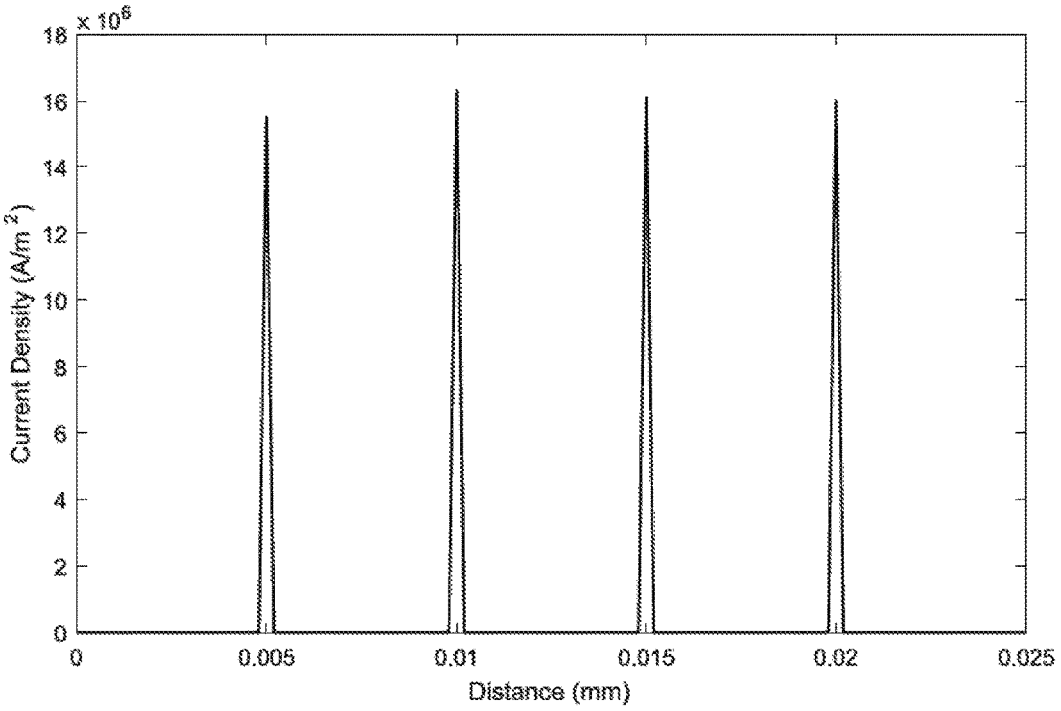
FIG. 6A is a graph showing the current densities across the line in FIG. 6B of a refrigerant tube in accordance with at least one example embodiment.
Figure 6B:
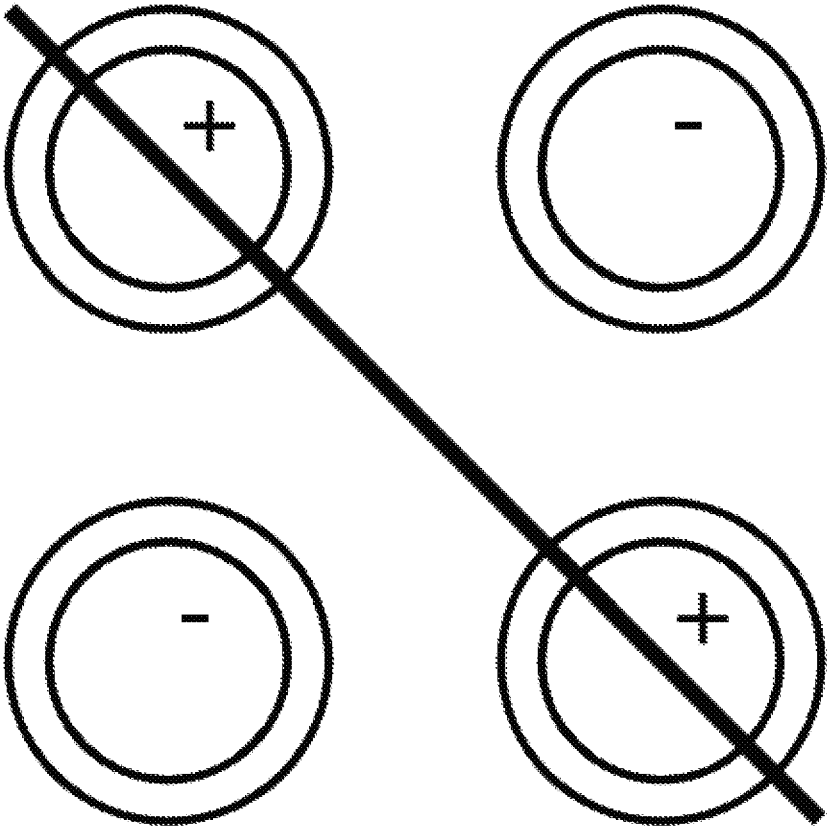
FIG. 6B is a cross-sectional view of a refrigerant tube in accordance with at least one example embodiment

On the other hand, for a coil similar to the one depicted in FIG. 4A, in which the double winding produces current flow among opposing current flow, a more uniform current density may be obtained, as shown in FIG. 6A. Similar to FIG. 5A, FIG. 6A provides the density as a function of distance in which the value of current density may be observed to be generally more uniform. A more uniform current density may result in more uniform heating, and thus uniform defrosting, throughout the coil. Conversely, non-uniform heating of the coil, for example, in which the ratio of the maximum current density to minimum current density exceeds 3 (e.g. the maximum current density is 3 times that of the minimum current density), may impact the defrosting performance since some portions of the coil may defrost sooner than other portions.

To appreciate the impact of the impedance due to coil inductance, a coil similar in configuration to the coil depicted in FIG. 3A (in which the current flow in adjacent tubes are in the same direction) may be compared with a coil configured in a manner similar to the coil depicted in FIG. 4A (in which the current flow in adjacent tubes are in opposing directions). For example, at 20 kHz, the inductance for a coil similar to FIG. 3A may be calculated using equation 10, resulting in a total impedance of 120Ω, compared with an AC resistance of 10Ω. However, for a coil similar to FIG. 4A in which the coil may be wound to cause current to flow in opposite directions, and using the inductance calculation via equation 9, results in a total impedance of 13Ω, compared with an AC resistance of 10Ω. Where the impedance is more than 5 times that of the AC resistance, the power factor for resistive and electromagnetic heating may be significantly reduced, thereby weakening the defrosting performance of the coil. Additionally, the electronics required for a defrosting system in which the inductive impedance is more than five times that of the AC resistance may be more expensive.

Figure 7:
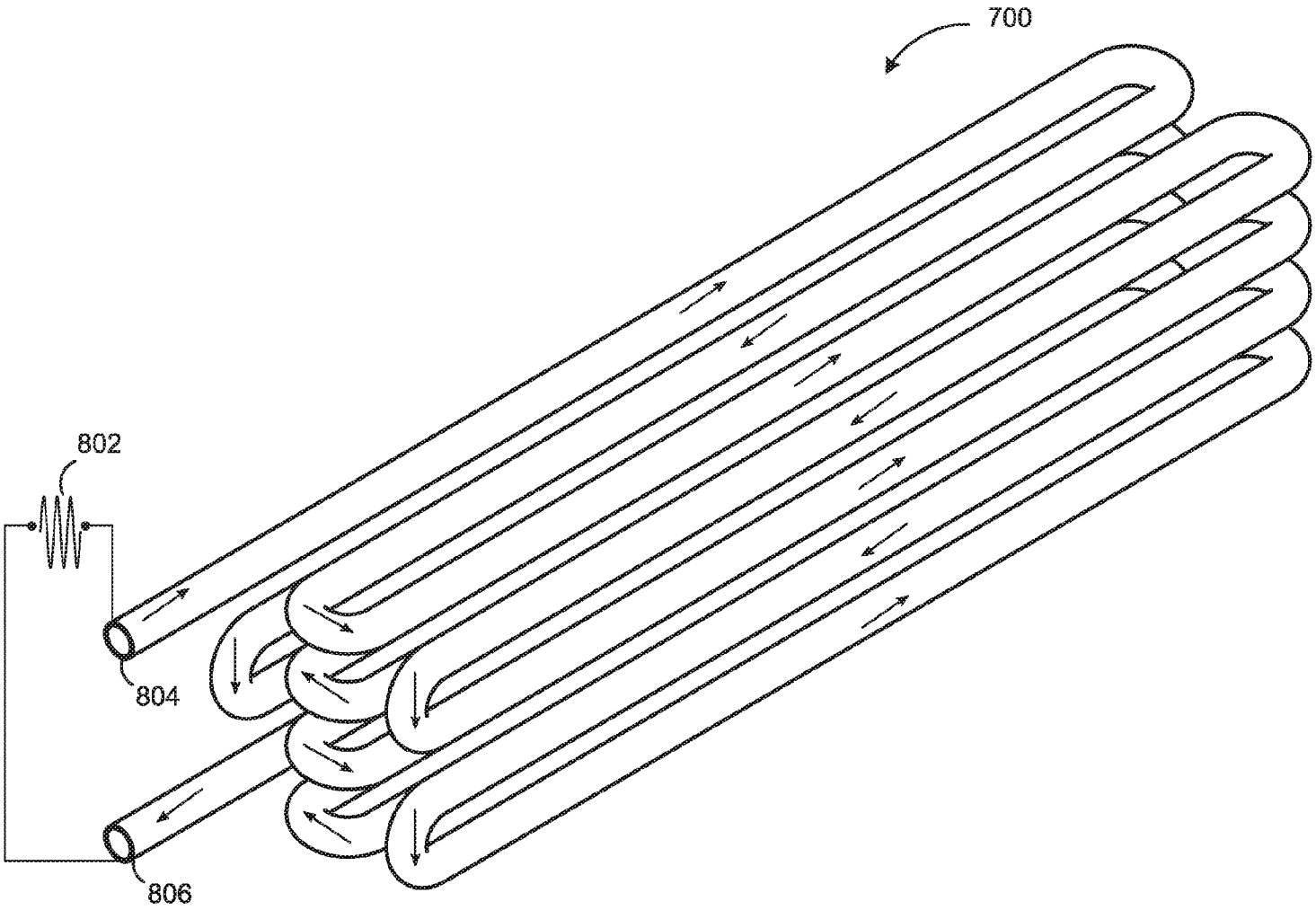
FIGS. 7 and 8 are diagrams of a bank of parallel refrigerant tubes in accordance with at least one example embodiment.
Figure 8:
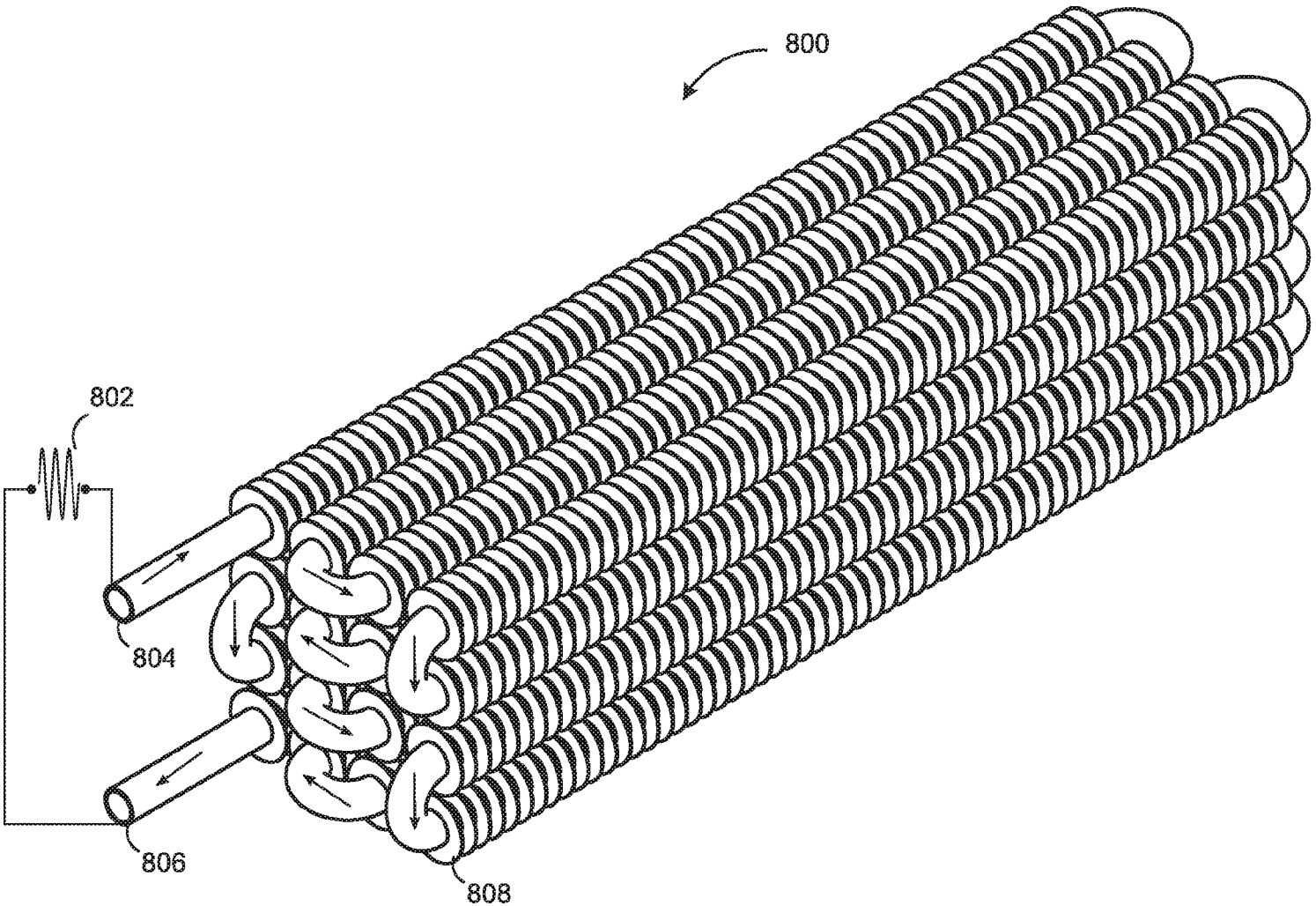

FIG. 7 shows yet another embodiment in which a bank of parallel refrigerant tubes 700 may be configured to cause current to flow in opposing directions as shown by the arrows. A high-frequency AC source 802 may be applied to the first end 804 and second end 806 such that current flow can be induced within the coil to flow between the first end 804 to the second end 806. The coil may also make use of the skin effect and magnetic losses to increase the total resistance by optimizing both the frequency and current. Similar to the coil of FIG. 4A, the proximity effect may be reduced. The impedance due to inductance of such a coil may also be reduced and can be calculated using equation 9. In another embodiment shown in FIG. 8, a bank of parallel tubes similar to the tube depicted in FIG. 7 may include circular fins on the surface of the tube, with the condition that the fins from different tubes do not touch so that not to short-circuit the tubes. In other embodiments, the fins may be of other shapes including, but not limited to, spiral and spine shapes.

In another embodiment, non-ferromagnetic metal parts may be heated more efficiently by providing a thin ferromagnetic coating on a surface of a metal part and then i) exposing the coating to HF-electromagnetic field, and/or ii) passing HF-electric current through the part. When the frequency of the excitation is high enough, all or most of the induced electric current can be constrained inside the thin ferromagnetic coating (so-called skin-effect), which can provide more efficient Joule heating due to high electrical resistance of thin coating. In analogous ways, the skin effect can be induced in any ferromagnetic metal coated material.

Figure 16:
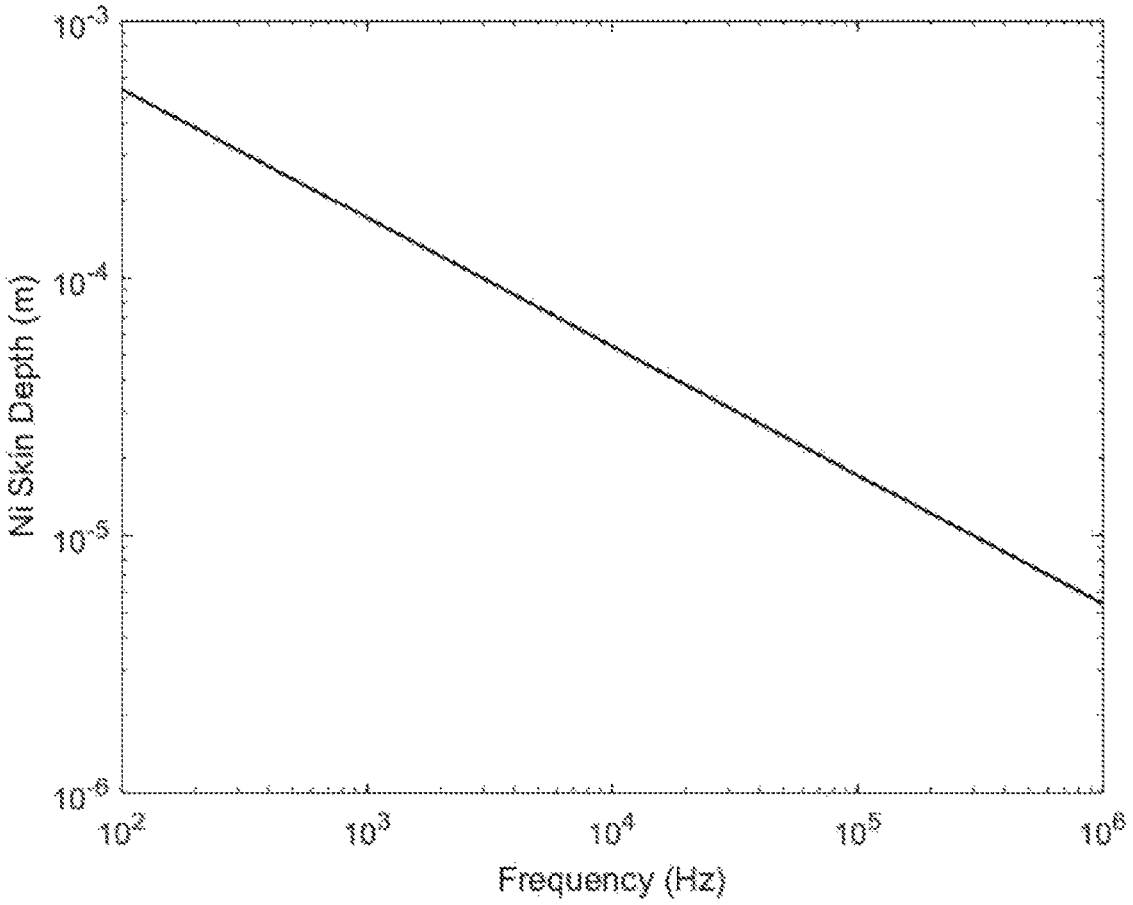
FIG. 16 is a graph showing skin depth in pure annealed nickel versus frequency of excitation in Hertz (Hz)

Electro-less and electro-plated nickel coatings can be used to increase corrosion resistance, hardness and abrasion-resistance. FIG. 16 shows a skin depth of less than 25 μm in pure annealed nickel at a frequency greater than 50 kHz. Thus, for a metal part coated with 2 mil (50 μm) nickel, almost all the HF-current may pass through the coating and not through the body of the part.

Figure 17A:
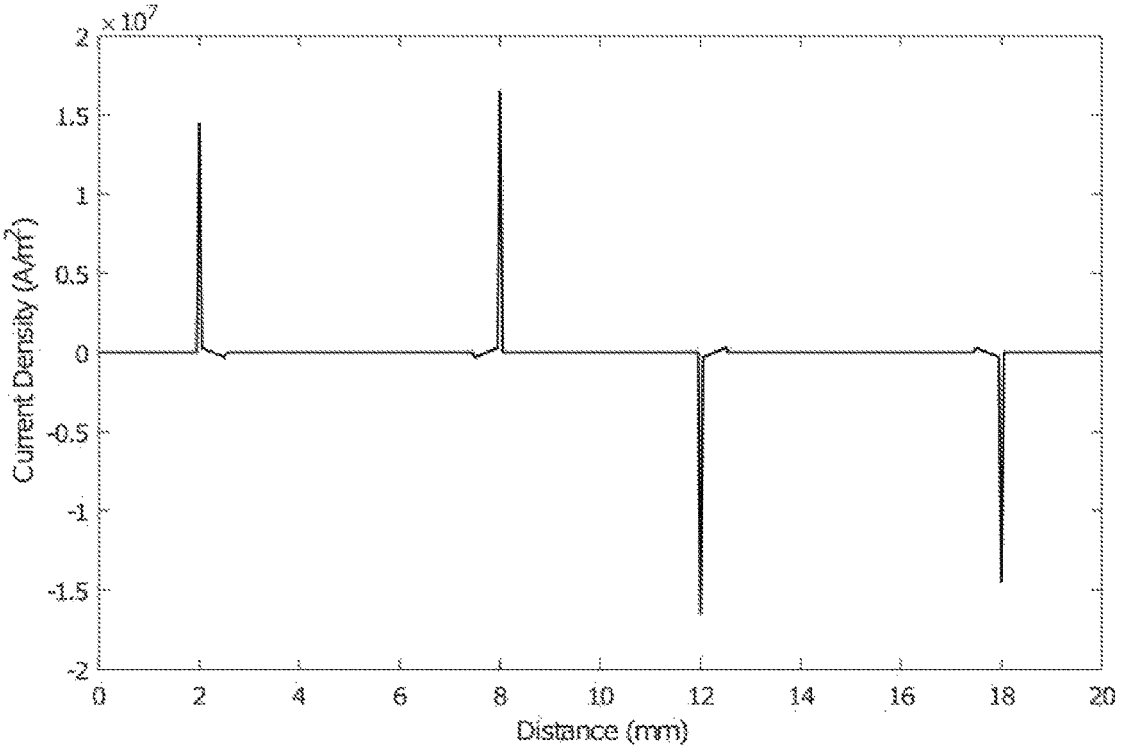
FIG. 17A is a graph showing the current densities across the solid line shown in the cross sectional view in FIG. 17B of the refrigerant tubes in accordance with at least one example embodiment
Figure 17B:
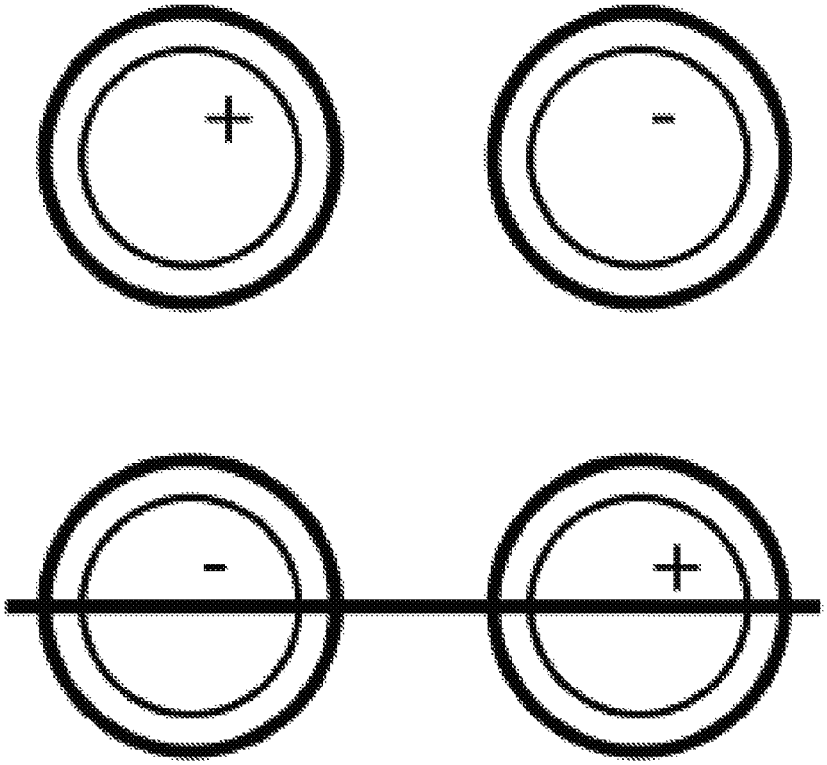
FIG. 17B is a cross-sectional view of a bundle of aluminum tubes having a thin external layer of nickel.

FIG. 17A shows an example of heating a bundle of aluminum tubes having external thin layer of nickel. FIG. 17B shows a cross-sectional view of the four aluminum tubes from FIG. 17A with outer diameter of 7 mm, inner diameter of 6 mm and coated with 50 μm nickel layer at their outside surface. Returning to FIG. 17A, the amplitude of HF-current flowing in z-direction (perpendicular to the figure plane) is shown for each tube in FIG. 17B. The line shows direction along arc length of the four aluminum tubes in FIG. 17B. FIG. 17A shows a graph of the current density along the line shown. As it is seen, almost all the current is located inside the nickel coating. For total current of 10 A/tube: $I_{Ni}$=10.383 A/tube and $I_{Al}$=−0.383 A/tube (i.e. only roughly 3.83% of the current flows in the aluminum tube).

Figure 9A:
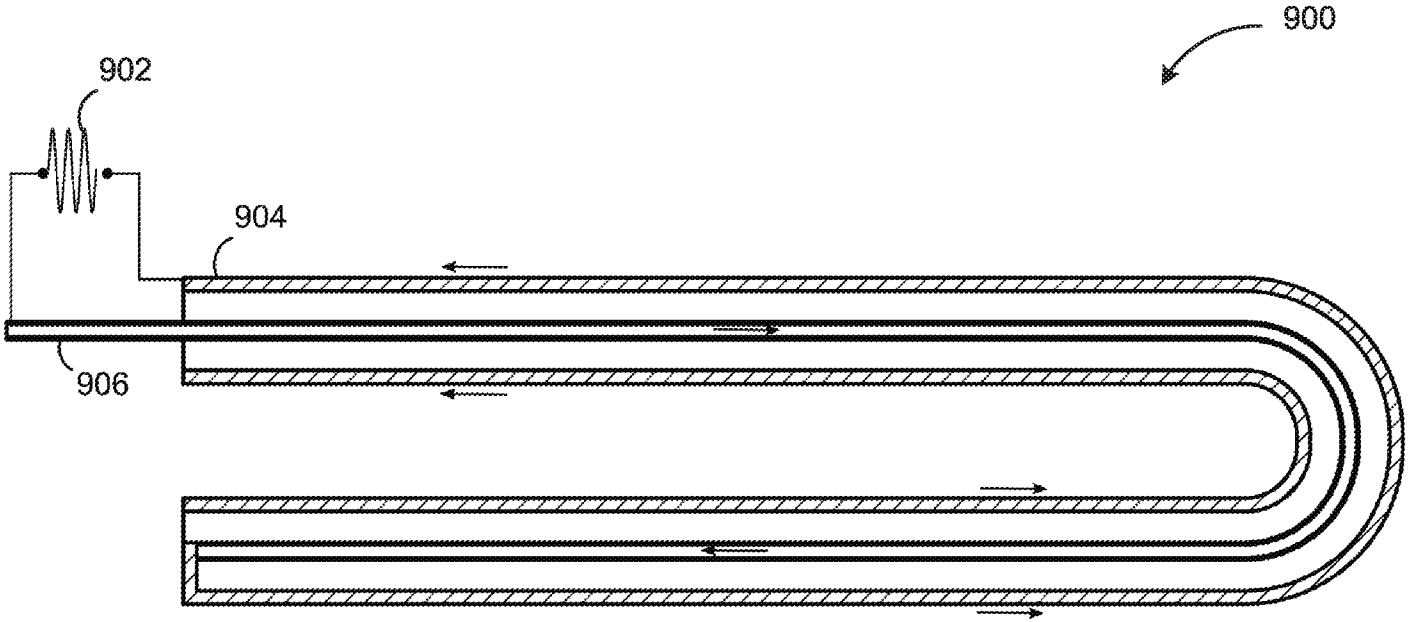
FIG. 9A is a diagram of a coaxial refrigerant tube in accordance with at least one example embodiment.
Figure 9B:
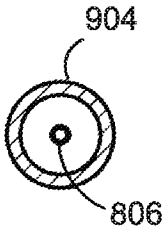
FIG. 9B is a cross-sectional view of the coaxial refrigerant tube in FIG. 9A.

FIGS. 9A and 9B are diagrams of an embodiment of a refrigerant tube 900 with an internal coaxial conductor. FIG. 9A shows a cross-sectional view along the long axis of the tube, while FIG. 9B shows a cross-sectional view along the short axis of the tube. Specifically, an insulated coaxial central wire 906 may be embedded inside the tube as shown in FIG. 9A. The coaxial central wire 906 and the tube 904 may be electrically connected at one end, which may cause adjacent current paths to carry current that flows in opposite directions as shown by the arrows, and therefore reduce proximity effect and impedance due to inductance.

Such a configuration can improve the operation of fin-on-tube configurations, because high frequency along with a coaxial cable can be used to restrict electrical current flow to the inner surface of the tube. This can be done by inserting an insulated coaxial cable/conductor inside the tube. The central wire could be any type of wire rated for the current, e.g. a 1 mm Litz magnet wire. The wire can be connected to one end of the tube. The other end of the wire and the other end of the tube can be used as the connecting point for the high frequency voltage power source. The tube could be made of a ferromagnetic material or it could be made of copper or aluminum and coated with a thin nickel (or other ferromagnetic) layer on its inner surface. Since the current can be restricted to the most inner layer of the tube, this has the advantage that the external fins, attached to the exterior of the tube, can be separated from this current. Therefore, plate fins can be used on multiple tubes without the fear of short circuiting in this case.

Figure 18A:
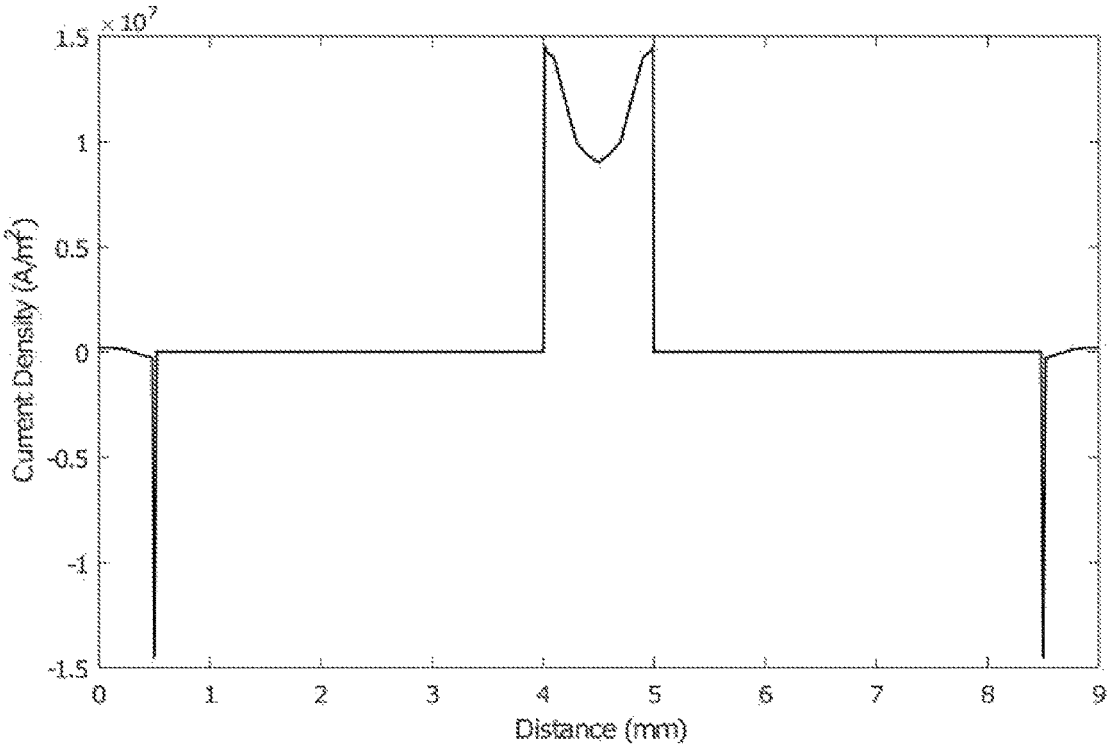
FIG. 18A is a graph showing current density across the solid line shown in the cross sectional view in FIG. 18B of the refrigerant tube in accordance with at least one example embodiment.
Figure 18B:
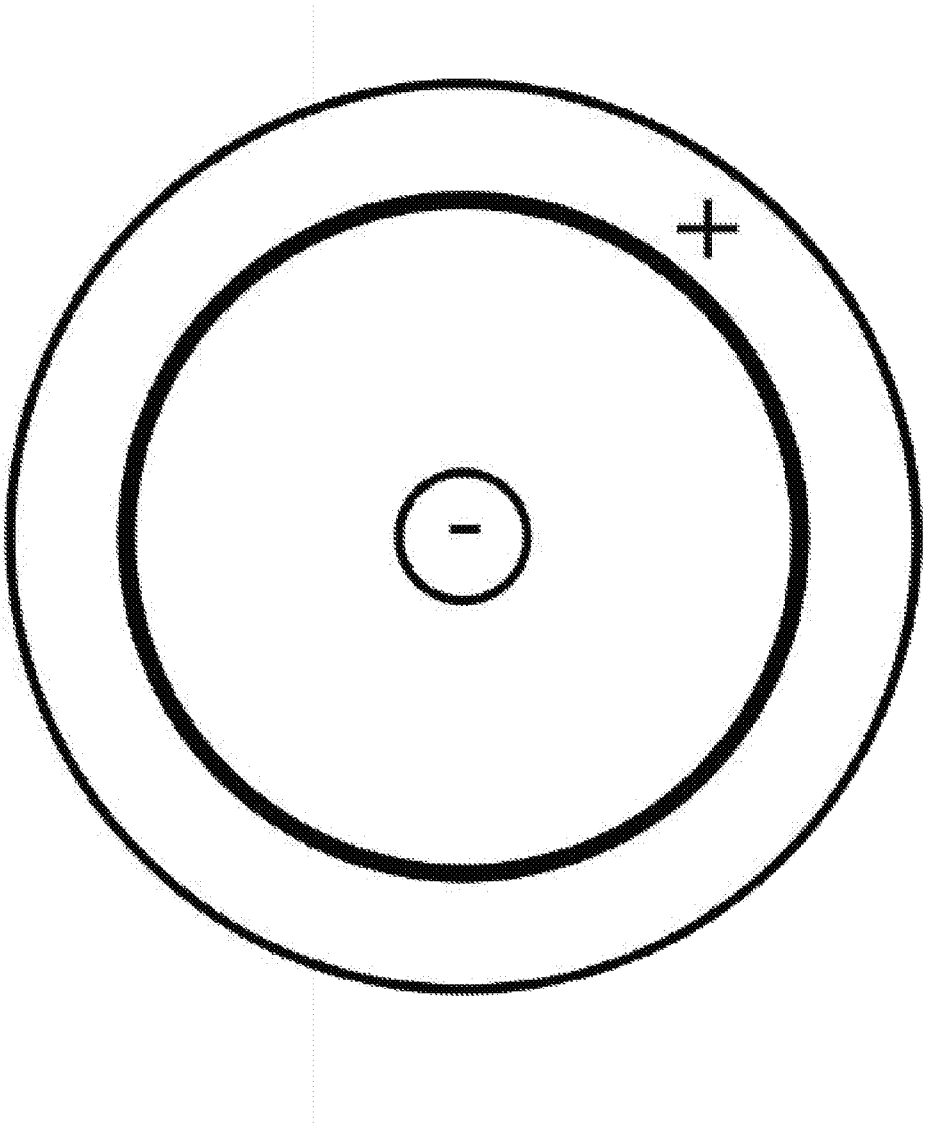
FIG. 18B is a cross-sectional view of an aluminum tube.

FIG. 18A shows a graph showing current density across the solid line shown in the cross sectional view of the refrigerant tube in FIG. 18B.

FIG. 18B shows a cross-sectional view of aluminum tubes of outer diameter of 9 mm, inner diameter of 8 mm and coated with 50 μm nickel layer on its inner surface with a coaxial copper wire with diameter of 1 mm. A current of 10 A at a frequency of 50 kHz can be provided, as shown, running in opposite directions in the tube and the wire. More details on the current density can be seen in the current density graph in FIG. 18A, which shows the current density along the tube diameter. FIG. 18A shows the current density along the tube diameter of FIG. 18B. As it is seen, almost all the current is located inside the nickel coating. The current amplitude is 10 A/tube. As can be seen, only 2% of the current flows through the aluminum tube since most current is restricted to the inner ferromagnetic surface. Because there is little current flowing along the outside of the tubes, plate fins that connect multiple tubes may no longer short-circuit the coil. This effect can be achieved by either using ferromagnetic tubes, or tubes made of other materials with an interior ferromagnetic coating.

In another embodiment, rapid defrosting can be applied to fin-on-tube evaporators without short-circuiting. This can be achieved by using a thin coating that covers the outside surface of the evaporator tubes before fitting the fins (e.g. plate fins, slit fins or louver fins) on the evaporator tubes. The coating (e.g. nylon) can be very thin and can be electrically insulating but thermally conductive. The tubes in this case could be made from a ferromagnetic material or from a non-ferromagnetic material but coated with a ferromagnetic coating as described above. Because the tubes are electrically insulated from the fins, high frequency current can be passed through them to heat the tubes, without the fins causing a short-circuit between the tubes.

Figures 10A, 10B:
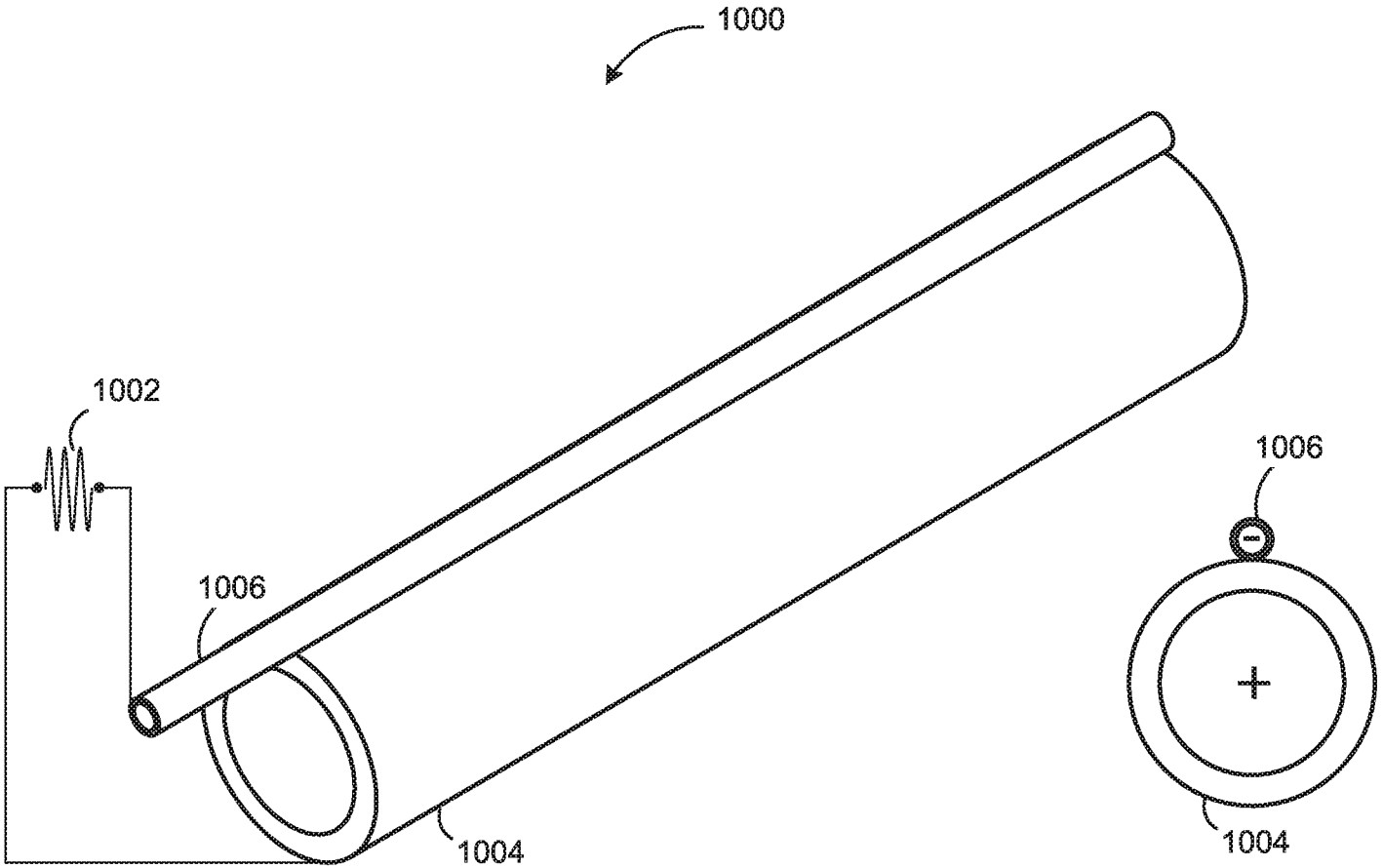
FIG. 10A is a diagram of a refrigerant tube with an external conductor in accordance with at least one example embodiment.
FIG. 10B is a cross-sectional view of the refrigerant tube with an external conductor in FIG. 10A.

FIGS. 10A and 10B are diagrams of an embodiment of a refrigerant tube 1000 with an external conductor. FIG. 10A shows a perspective view of the tube 1004 and conductor 1006, while FIG. 10B shows a cross-sectional view of the tube 1004 and conductor 1006. Specifically, this refrigerant tube 1000 may be regarded as being similar to the tube of FIGS. 9A and 9B, except that the external conductor 1006 (e.g. a wire or some other suitable conductor) may be extended externally along the tube 1004.

Figure 11:
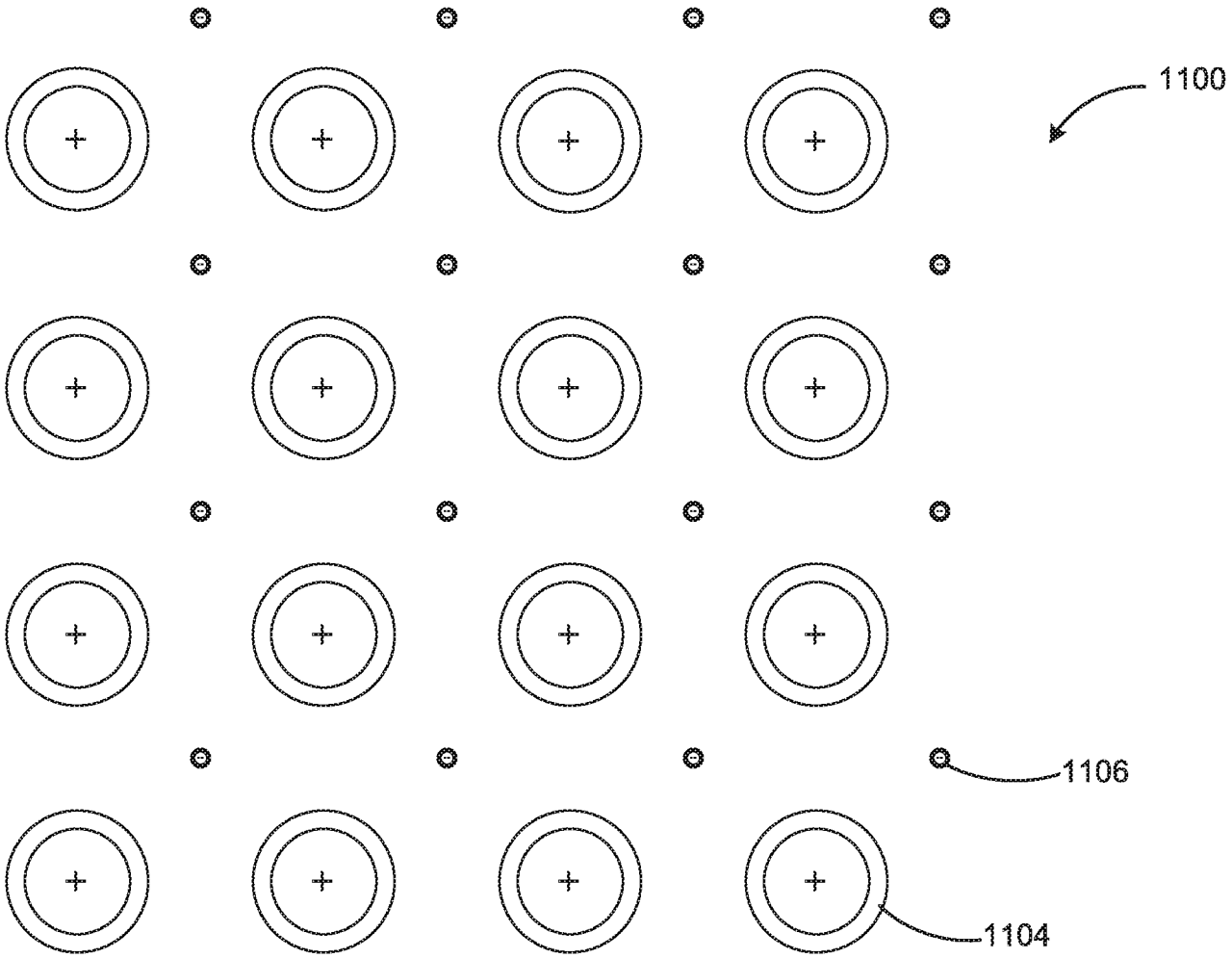
FIG. 11 is a diagram of a set of refrigerant tubes with external conductors in accordance with at least one example embodiment.

FIG. 11 is a diagram of an embodiment of a refrigerant tube 1100 in which a number conductive wires 1106 may be spread between a set of tubes 1104. This configuration may be used to provide opposite current flow in adjacent current paths, without requiring the conductive wire 1106 to be coaxial or on the surface of the refrigerant tube 1104.

Figure 12:
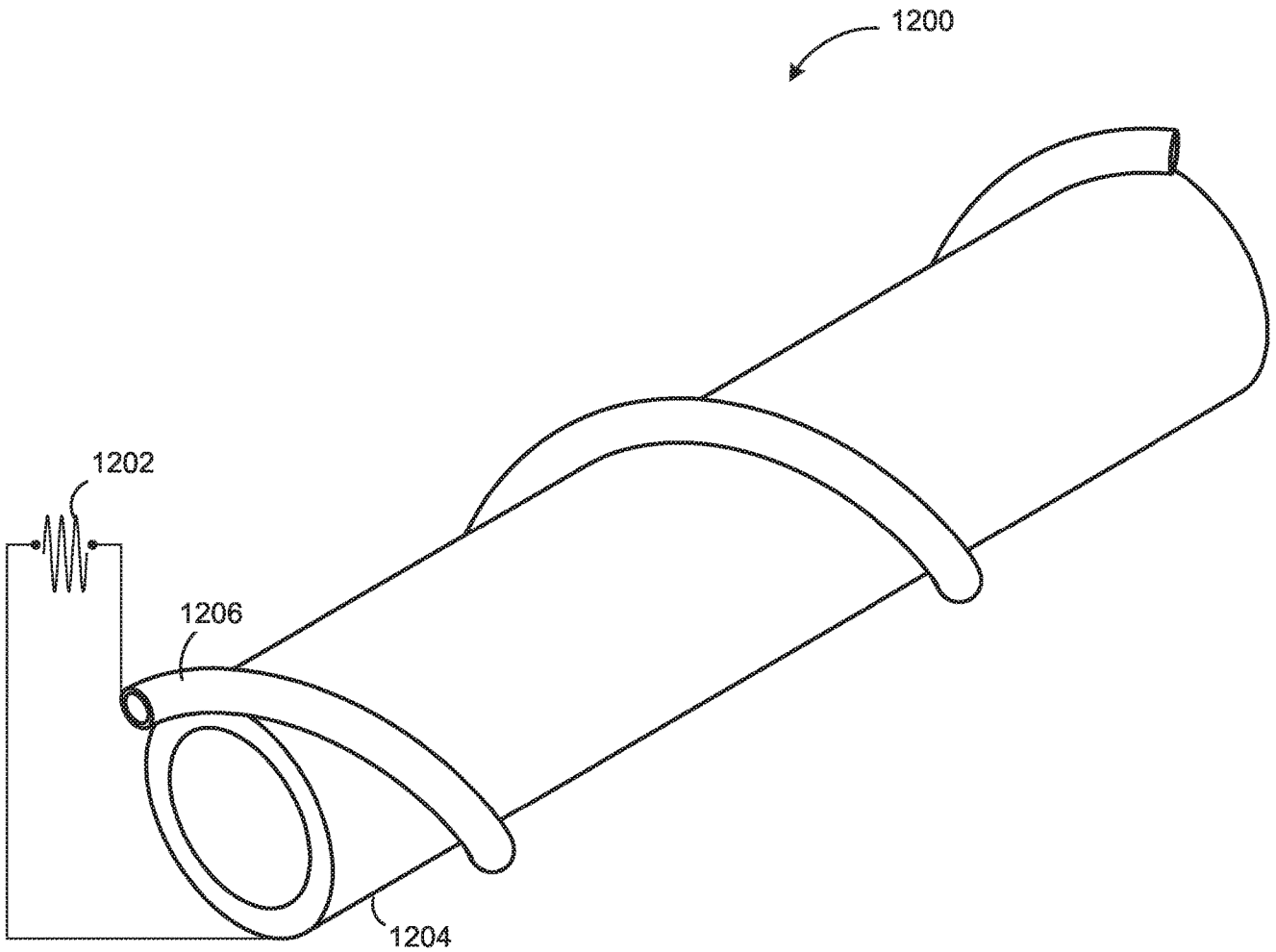
FIG. 12 is a diagram a refrigerant tube with a helically wound external conductor in accordance with at least one example embodiment.

FIG. 12 is a diagram of an embodiment of a refrigerant tube 1200 in which an external conductor 1206 may be wound helically around the tube 1204. In the present embodiment, the external conductor 1206 may be a wire or more specifically a square magnetic wire with thin insulation. In the present embodiment, the external conductor 1206 may act as a small spiral fin and may also increase the turbulence of air flow around the tube 1204 which enhances the heat transfer between the evaporator coil and the surround air.

In yet other embodiments (not shown) similar to the previously presented embodiments, fins (circular, spiral, spine, . . . etc.) may be added with the condition that the fins belonging to different tubes do not touch each other in order to prevent short-circuiting (except for the embodiment of FIGS. 9A and 9B where the tubes may have common fins).

Electronic Circuit

Figure 13:
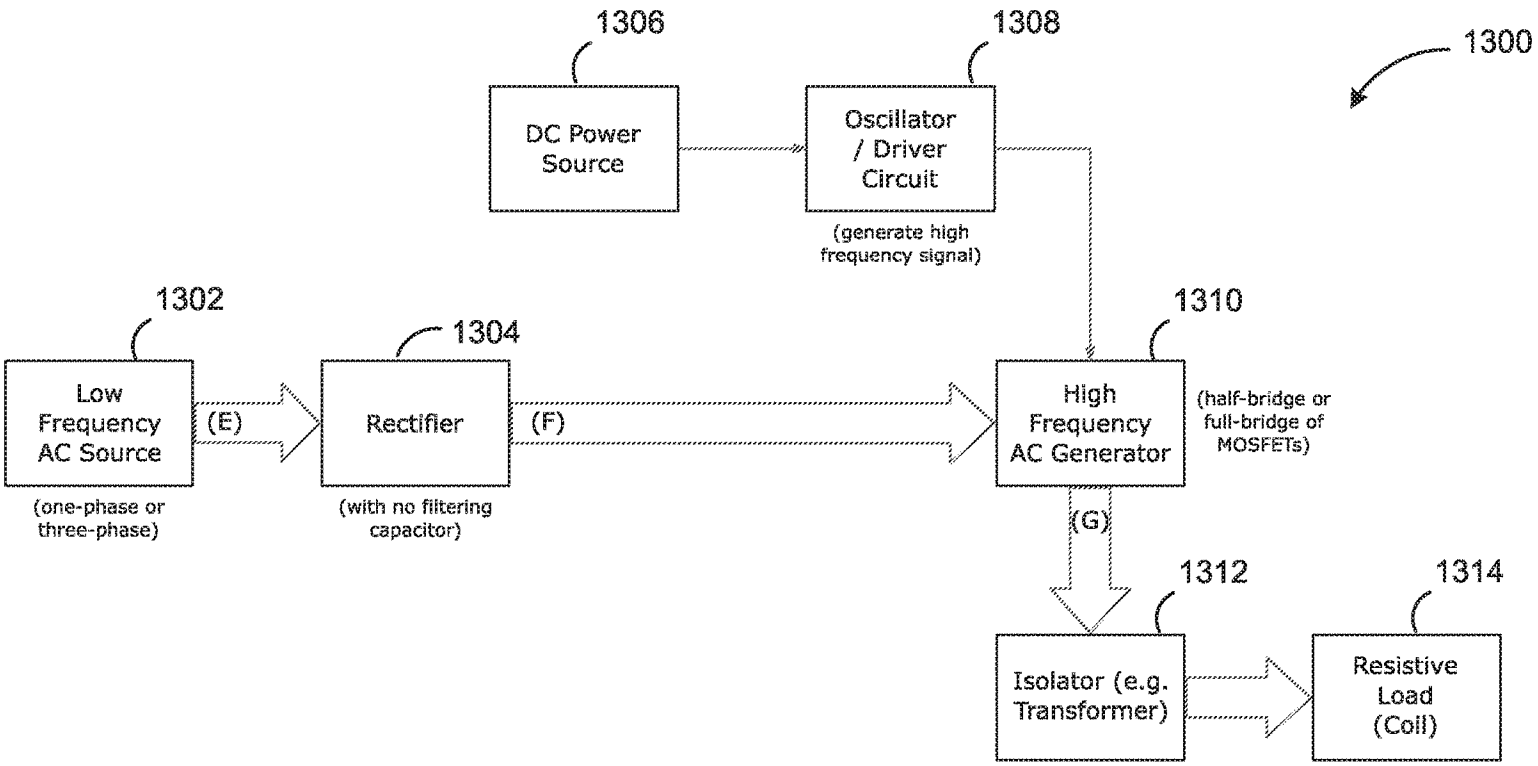
FIGS. 13 and 14 are block diagrams of circuits for generating a high-frequency AC in accordance with at least one example embodiment.

Reference is now made to FIG. 13, which is a block diagram of an electronic circuit 1300 for providing the high-frequency AC in accordance with at least one example embodiment. The design of the circuit may be used to 1) provide high frequency power for heating ferromagnetic evaporators; and 2) provide high current. This electronic circuit 1300 may be regarded as a variation of the circuit of FIG. 2A which has been described previously.

A well-filtered DC power source 1306 may be configured to provide power to the driver circuit 1308, which provides a high frequency signal or waveform. In some embodiments, the DC power may be provided by a battery that would not typically require filtering. The driver circuit 1308 may be any component suitable of generating a high-frequency signal. For example, the driver circuit 1308 may be a half-bridge gate driver or any suitable oscillator capable of generating a high frequency signal. A low frequency AC source 1302 may be rectified by a rectifier 1304. An optional stopper filter (not shown) can be used after the rectifier to prevent high frequency noise propagating back to main power network. A stopper filter can include an inductor connected in series and a capacitor connected in parallel that operates to filter out high-frequency RF signals. The stopper filter may filter out signals above a frequency of 9 kHz. In another embodiment, the stopper filter may filter out signals between 9 kHz and 10 GHz. In some embodiments, the stopper filter would not filter out line voltage signals at, say, a frequency of 60 Hz In the present embodiment, the output of the driver circuit 1308 and the output of the rectifier 1304 may be provided to the high-frequency AC generator 1310 to produce a high-frequency AC signal at line voltages that may be provided to the resistive load 1314 which, in the present context, may be an evaporator coil. In the present embodiment, the high frequency AC generator 1310 may be half-bridge or full-bridge power MOSFET transistors. The electronic circuit 1300 of FIG. 13 may be regarded as having a power circuit component including the rectifier 1304 and high frequency AC generator 1310 for providing a high power/high current unfiltered electrical pathway between the resistive load 1314 and the low frequency AC source 1302. Additionally, the electronic circuit 1300 of FIG. 13 may include a low power control circuit component including the DC power source 1306 and driver circuit 1308. Also shown in FIG. 13 is an isolator 1312, for example, a ferrite core high-frequency transformer to electrically isolate the resistive load 1314 from the low frequency AC source 1302. In some embodiments, the transformer maybe configured in a 1:1 ratio so that the voltage provide to the coil is the line voltage value. In some other embodiments, the transformer may also be used to further modify (i.e. step up or down) the voltage and current applied to the load. In yet other embodiments, however, the resistive load 1314 may be connected to the high frequency AC generator 1310 directly without electrical isolation.

Referring still to FIG. 13, while most aspects of the circuits may be familiar to those skilled in the art as they may also be found in traditional switched-mode power supplies (SMPSs), a key difference is that the high power electrical pathway from the output of the rectifier 1304 may be directly connected to the high-frequency AC generator 1310 without any signal conditioning or filtering. This unfiltered connection from the rectifier 1304 to the high frequency AC generator 1310 and then to the resistive load 1314 can distinguish the circuit of FIG. 13 from other SMPSs. Generally, signal conditioning circuits, such as an expensive filtering capacitor to remove pulsations or other circuitry to turn the rectified AC to a DC signal, may be present between the rectifier 1304 and the high frequency AC generator 1310. However, such a capacitor may not be necessary to achieve the desired resistive or electromagnetic heating using the circuit of FIG. 13. Therefore, cost savings can be realized by omitting the expensive filtering capacitor for the high power pathway even if a relatively low cost filtering capacitor is provided in the DC power source 1306 for the low power circuit component. Of course, as mentioned above, filtering would typically not be needed for a DC power source, such as a battery.

Figure 15:
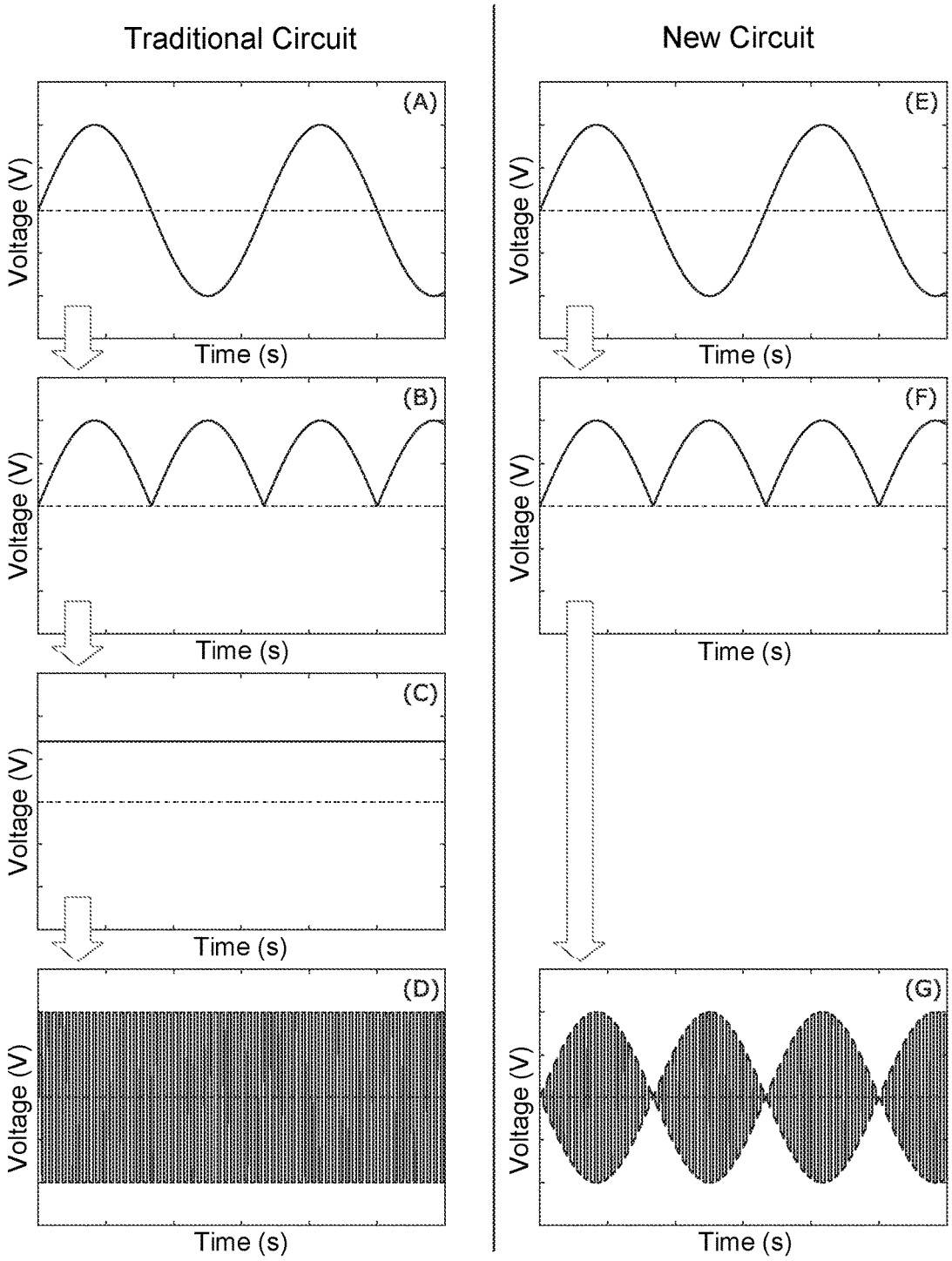
FIG. 15 is a graph showing waveform at various locations of a traditional high-frequency AC generating circuit and the circuits of FIGS. 13 and 14 and in accordance with at least one example embodiment.

An optional stopper filter (not shown) can be used after the rectifier to prevent high frequency noise propagating back to main power network. A stopper filter may include an inductor connected in series and a capacitor connected in parallel. Noise in the circuit can be caused by internal elements of the circuit from MOSFETs, transformer or any other component or ICs, which may produce noise. The range of frequency where the noise is present is typically from 9 kHz to 10 GHz. Thus to remove this noise, and prevent it from propagating back to main power network, such stopper/EMI filter can be used. This is typically a high frequency filter, which can be inexpensive compared to the filter required to remove line frequency pulsations in the power circuit. FIG. 15 shows the various waveform shapes that can be provided as an AC waveform passes through a circuit for defrosting using high-frequency AC. The left column shows the waveforms that may be observed at various points along a traditional circuit equipped with a filtering capacitor (not shown) that would be placed between the rectifier 1304 and the high frequency AC generator 1310 of FIG. 13. Typically, with a traditional circuit, a low frequency AC waveform entering the circuit may be a sinusoid (i.e. 120V at 60 Hz) as shown in FIG. 15(A). The sinusoid may first be rectified to a constant polarity pulsating waveform (i.e. at 120 Hz) as shown in FIG. 15(B), then filtered (usually with a large and generally expensive capacitor) to remove the 120 V/120 Hz pulsations. The resultant signal after filtering the pulsations may be a DC signal, as shown in FIG. 15(C). When such a signal is received by the high frequency AC generator 1310, the output produced may be a high frequency wave, the output frequency and shape (e.g. square, sinusoidal, triangular, . . . etc.) being controllable by the driver circuit. An example of a high frequency square wave is shown in FIG. 15(D).

The right-hand column of FIG. 15 shows the waveform shapes that may be observed as an AC waveform passes through a circuit similar to the one described in FIG. 13. Specifically, no filtering need be performed between the rectifier 1304 and the high frequency AC generator 1310. The low frequency AC waveform as shown in FIG. 15(E) and the resultant rectified waveform as shown in FIG. 15 (F) correspond to those shown in FIGS. 15(A) and (B). The constant polarity pulsating waveform of FIG. 15(F) may remain as is as it is received by the high-frequency AC generator 1310, that is, it is not filtered to remove 120 V/120 Hz pulsations. As a result, the high-frequency AC generator may receive halves of 60 Hz sinusoids as shown in FIG. 15(F), and the resultant high-frequency power output may be modulated with 120 Hz, as shown in FIG. 15(G). Such an output would often be unacceptable in consumer electronics, but can be acceptable for heating applications. Producing such a high-frequency power output in this manner may reduce the overall cost of the electronics by approximately one half.

Figure 14:
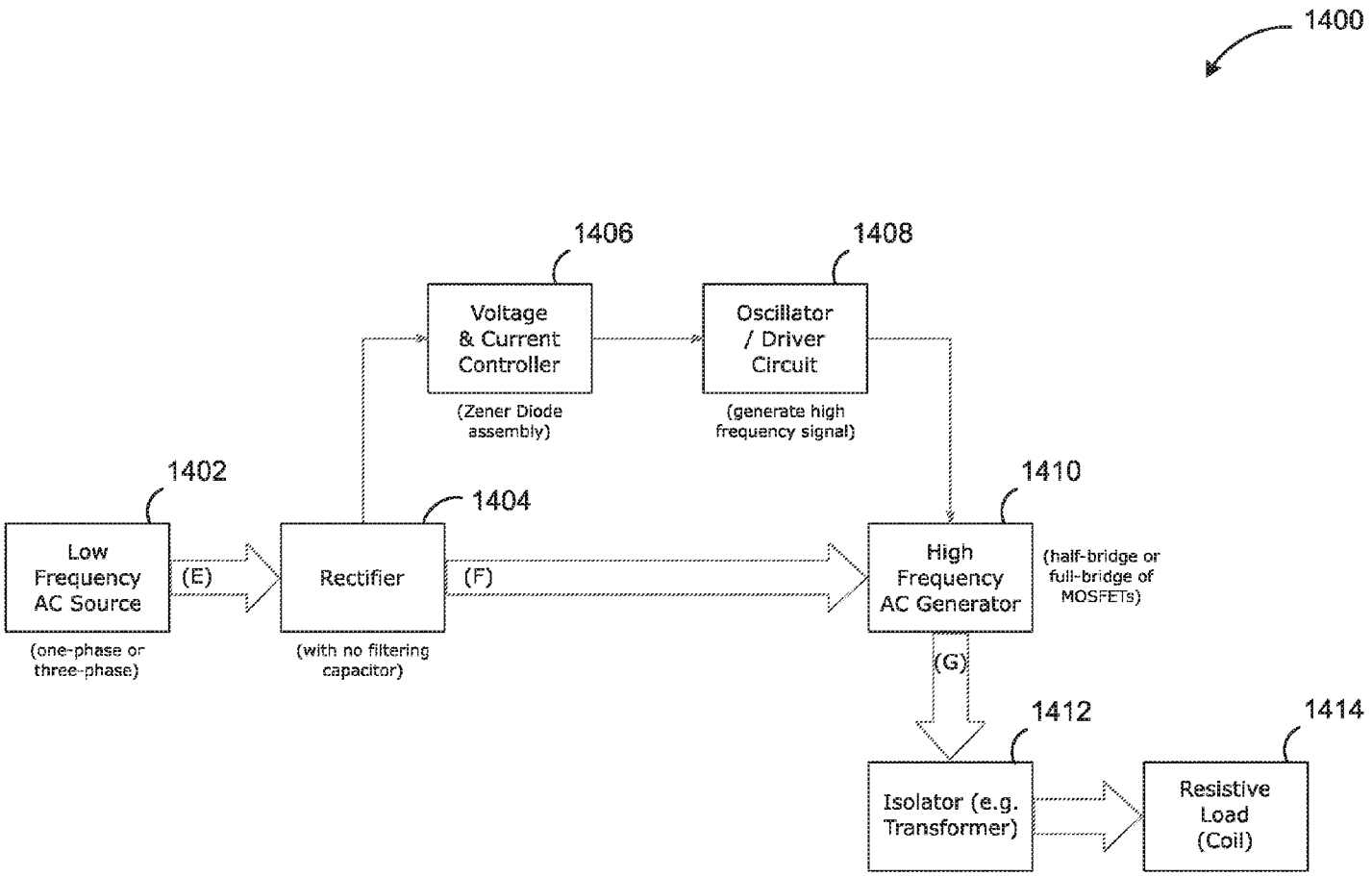

Reference is now made to FIG. 14, which is a block diagram of an electronic circuit 1400 in accordance with at least one example embodiment. The circuit 1400 of FIG. 14 may be regarded as a variation of the circuit 1300 of FIG. 13 such that the same key difference between electronic circuit 1400 and existing SMPSs also apply. In the present embodiment, the well-filtered DC power source 1306 of FIG. 13 may be replaced with a voltage and current controller 1406 such that the power to the driver circuit 1408 may be obtained directly from low frequency AC source 1402 via the rectifier 1404. Specifically, in the present embodiment, control of the current and voltage to power the driver circuit 1408 may be accomplished through a Zener Diode assembly. As such, the overall cost of the electronics can be reduced further. The electronic circuit 1400 of FIG. 14 may similarly be regarded as having a power circuit component including the rectifier 1404 and high frequency AC generator 1410 for providing a high power/high current unfiltered electrical pathway between the resistive load 1414 and the low frequency AC source 1402. Additionally, the electronic circuit 1400 of FIG. 14 may include low power control circuit component which includes the voltage and current controller 1406 and driver circuit 1408 to provide a second electrical pathway between the resistive load 1414 and the low frequency AC source 1402. Like the circuit of FIG. 13, cost savings can again be realized by omitting the expensive filtering capacitor for the high power pathway even if a relatively low cost filtering capacitor is provided in the voltage and current controller 1406 for the low power circuit component.

Under circumstances in which the current requirement does not exceed the current available from an AC line, the transformer isolator 1312 of FIG. 13 and transformer isolator 1412 of FIG. 14 may be replaced with a capacitor. As such the cost associated with building both variations of the circuit may be comparable. However, the variation which includes the transformer may provide higher flexibility in terms of output power and current in addition to providing electrical isolation between the coil 1414 and the AC source 1402. For example, in the variation which includes the transformer, the output voltage and current may be further adjusted by modifying the ratio of the transformer primary and secondary windings.

The present invention has been described here by way of example only. Various modification and variations may be made to these exemplary embodiments without departing from the spirit and scope of the invention.

The invention claimed is:

1. A method of configuring an evaporator coil, the method comprising:

providing a refrigerant tube formed from an electrically conductive material, an upstream refrigerant conduit for supplying a refrigerant to the refrigerant tube, and a downstream refrigerant conduit for receiving the refrigerant from the refrigerant tube;

determining at least one of a desired resistive heating and electromagnetic heating for defrosting the refrigerant tube;

providing an electrical coupler, connectable to a standard line voltage from an external power source, the standard line voltage having an externally determined voltage value and an externally determined standard line frequency;

determining at least one parameter of the refrigerant tube;

based on the at least one parameter of the refrigerant tube, determining a target frequency of a high-frequency alternating current to apply to the refrigerant tube to provide the at least one of the desired resistive heating and electromagnetic heating when the high-frequency alternating current is applied to the refrigerant tube, the target frequency being higher than the externally determined standard line frequency; and configuring and providing an electronic circuit electrically connectable between the standard line voltage and the refrigerant tube to receive and transform the standard line voltage to provide the high-frequency alternating current at the target frequency in the refrigerant tube, the target frequency being higher than an externally determined frequency of the externally determined voltage.

2. The method as defined in claim 1, wherein determining the target frequency of the high-frequency alternating current to apply to the refrigerant tube comprises determining a target resistance of the refrigerant tube for providing the at least one of the desired resistive heating and electromagnetic heating for defrosting the refrigerant tube when the refrigerant tube is connected to the standard line voltage, and then adjusting the target frequency to provide the target resistance.

3. The method as defined in claim 2, wherein the at least one parameter of the refrigerant tube comprises at least two of an electrical resistivity of the refrigerant tube, a relative magnetic permeability of the refrigerant tube and a magnetic loss obtainable from the refrigerant tube; and determining the target frequency of the high-frequency alternating current applied to the refrigerant tube to provide the target resistance to the refrigerant tube comprises determining the at least two of the electrical resistivity of the refrigerant tube;

the relative magnetic permeability of the refrigerant tube; and the magnetic loss obtainable from the refrigerant tube; and based on the at least two of the electrical resistivity, the magnetic permeability and magnetic loss, determining the target frequency of the alternating current to apply to the refrigerant tube to provide the target resistance in the refrigerant tube.

4. The method as defined in claim 3, wherein providing the refrigerant tube formed from the electrically conductive material comprises determining a minimum relative magnetic permeability, and then selecting the electrically conductive material such that the relative magnetic permeability of the electrically conductive material exceeds the minimum relative magnetic permeability.

5. The method as defined in claim 4, wherein the selected electrically conductive material has a relative magnetic permeability of higher than 700.

6. The method as defined in claim 4, wherein the selected electrically conductive material has a relative magnetic permeability of higher than 40.

7. The method as defined in claim 6, wherein the target frequency is between 1 kHz and 250 kHz.

8. The method as defined in claim 2, wherein the at least one parameter of the refrigerant tube comprises an electrical resistivity of the refrigerant tube, a relative magnetic permeability of the refrigerant tube and a magnetic loss obtainable from the refrigerant tube;

determining the target frequency of the high-frequency alternating current applied to the refrigerant tube to provide the target resistance to the refrigerant tube comprises determining the electrical resistivity of the refrigerant tube;

determining the relative magnetic permeability of the refrigerant tube;

determining the magnetic loss obtainable from the refrigerant tube; and based on the electrical resistivity, the magnetic permeability and magnetic loss, determining the target frequency of the alternating current to apply to the refrigerant tube to provide the target resistance in the refrigerant tube.

9. The method of claim 2, wherein the method further comprises configuring the electronic circuit to output the target frequency to provide a power dissipation density due to the at least one of the resistive heating and electromagnetic heating at the refrigerant tube of at least 0.2 kW per square meter of the refrigerant tube surface area.

10. The method of claim 2, wherein the method further comprises configuring the electronic circuit to output the target frequency to provide a power dissipation density due to the at least one of the resistive heating and electromagnetic heating at the refrigerant tube of at least 1 kW per square meter of the refrigerant tube surface area.

11. An evaporator comprising a refrigerant tube providing an electrical path and a heat transfer surface, the electrical path being formed of an electrically conductive material having a relative magnetic permeability higher than 40 and being in thermal communication with the heat transfer surface to transfer heat to the heat transfer surface;

an upstream refrigerant conduit for supplying a refrigerant to the refrigerant tube;

a downstream refrigerant conduit for receiving the refrigerant from the refrigerant tube;

an upstream electrical isolation element for electrically isolating the refrigerant tube from the upstream refrigerant manifold;

a downstream electrical isolation element between the refrigerant tube and the downstream refrigerant manifold;

an electrical coupler connectable to a standard line voltage from an external power source, the standard line voltage having an externally determined voltage value and standard line frequency; and an electronic circuit electrically connectable between a standard line voltage and the refrigerant tube, in operation the electronic circuit receiving and transforming the standard line voltage to provide a high-frequency alternating current at a target frequency in the refrigerant tube, most of the high-frequency alternating current being provided in the electrical path, and the target frequency being higher than an externally determined frequency of the externally determined voltage;

wherein a total resistance obtained from applying the high-frequency alternating current to the electrical path of the refrigerant tube is at least 1.5 times a notional resistance obtainable from providing a direct current to the electrical path of the refrigerant tube.

12. The evaporator as defined in claim 11 wherein the refrigerant tube is formed from the electrically conductive material having the relative magnetic permeability higher than 40.

13. The evaporator as defined in claim 11 wherein the electrical path comprises an external layer of the refrigerant tube, the external layer being formed of the electrically conductive material and the heat transfer surface being an outer surface of the external layer; and, the refrigerant tube further comprises a metal having a relative magnetic permeability lower than 40.

14. The evaporator as defined in claim 11 further comprising external fins attached to the heat transfer surface of the refrigerant tube, wherein the electrical path comprises an internal layer of the refrigerant tube, the internal layer being formed of the electrically conductive material;

the electronic circuit comprising a coaxial cable to complete the circuit by carrying the high-frequency alternating current in an opposite direction of a flow of the high frequency alternating current in the internal layer of the refrigerant tube; and, the refrigerant tube further comprises a metal having a relative magnetic permeability lower than 40 for conducting heat from the internal layer to the heat transfer surface.

15. The evaporator as defined in claim 11, wherein the electronic circuit provides, when connected to the standard line voltage, an electrical connection between the standard line voltage and the refrigerant tube, such that the electrical connection comprises at least one electrical pathway that is not filtered to remove line voltage pulsations.

16. The evaporator as defined in claim 11, wherein the relative magnetic permeability of the electrically conductive material is higher than 700.

17. The evaporator as defined in claim 11, wherein the electrically conductive material, of the evaporator tube material is an alloy mostly comprising at least one of magnetic stainless steel, structural steel, carbon steel, Si steel, and nickel.

18. The evaporator as defined in claim 11, wherein at least a portion of the refrigerant tube, including the the electrically conductive material, comprises a plurality of parallel current flow paths for carrying the alternating current to create an inductance; and during operation, the plurality of parallel current flow paths comprises alternating current flowing in opposite directions such that an impedance associated with the inductance is less than five times that of a resistance obtainable in the plurality of parallel current flow paths.

19. The evaporator as defined in claim 18, wherein, during operation, a range of current densities between a minimum current density and a maximum current density is determinable in the plurality of parallel current flow paths, by defining a plurality of cross-sections along most of a length of the plurality of parallel current flow paths, and, for each cross-section in the plurality of cross-sections, determining a corresponding current density; and each parallel current flow path in the plurality of parallel current flow paths is separated from another parallel current flow path by a minimum distance such that a ratio of the maximum current density to the minimum current density is less than 3.

20. The evaporator as defined in claim 18, wherein for each current flow path in the plurality of parallel current flow paths, the plurality of parallel current flow paths comprises an associated closest current flow path such that no other current flow path in the plurality of parallel current flow paths is closer to that current flow path than the associated closest current flow path; and during operation, the alternating currents in that current flow path and its associated closest current flow path flow in opposite directions.

21. The evaporator as defined in claim 11, wherein the generated power dissipation density due to at least one of actual resistive heating and electromagnetic heating at the target frequency is at least 0.2 kW per square meter of the refrigerant tube.

22. The evaporator as defined in claim 11, wherein the generated power dissipation density due to at least one of actual resistive heating and electromagnetic heating at the target frequency is at least 1 kW per square meter of the refrigerant tube.

23. The evaporator as defined in claim 11, wherein the electronic circuit comprises an oscillating element configured to provide the high-frequency alternating current at least in the frequency range between 1 kHz and 250 kHz.

24. The evaporator of claim 11, wherein the electronic circuit electrically isolates the refrigerant tube from the external power source.

25. The evaporator of claim 11, wherein the electronic circuit comprises an AC rectifier for converting the standard line voltage to a constant polarity pulsating waveform, and without filtering to remove pulsations, connects the constant polarity pulsating waveform directly to a high-frequency AC generator for converting the constant polarity pulsating waveform to the high-frequency alternating current at the target frequency.

26. The evaporator of claim 25, wherein the electronic circuit comprises a stopper filter, the stopper filter comprising an inductor connected in series between the standard line voltage and the refrigerant tube, and a capacitor connected in parallel with the refrigerant tube.

27. The evaporator of claim 11, wherein at least 5% of the actual resistance obtained from applying the high-frequency alternating current to the refrigerant tube is attributable to a resistance associated with a magnetic loss obtainable from the refrigerant tube.

* * * * *